US010508830B2

(12) United States Patent
Zhang et al.

(10) Patent No.: US 10,508,830 B2
(45) Date of Patent: Dec. 17, 2019

(54) HIGH EFFICIENCY GAS-FIRED WATER HEATER

(71) Applicant: Rheem Manufacturing Company, Atlanta, GA (US)

(72) Inventors: Qian Zhang, Montgomery, AL (US); Troy E. Trant, Montgomery, AL (US); Timothy D. Scott, Tallassee, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 15/617,518

(22) Filed: Jun. 8, 2017

(65) Prior Publication Data

US 2018/0356126 A1 Dec. 13, 2018

(51) Int. Cl.

| | |
|---|---|
| ***F24H 8/00*** | (2006.01) |
| ***F24H 1/20*** | (2006.01) |
| ***F24H 9/14*** | (2006.01) |
| ***F28D 7/04*** | (2006.01) |
| *F28D 21/00* | (2006.01) |

(52) U.S. Cl.

CPC ..... *F24H 1/205* (2013.01); *F24H 9/146* (2013.01); *F28D 7/04* (2013.01); *F28D 2021/0024* (2013.01)

(58) Field of Classification Search

CPC ..... F24H 9/18; F24H 8/00; F24H 1/36; Y02B 30/102; F24D 19/08

See application file for complete search history.

(56) References Cited

U.S. PATENT DOCUMENTS

| | | | | |
|---|---|---|---|---|
| 2,911,957 | A * | 11/1959 | Kumm | F23C 15/00 122/13.01 |
| 5,179,914 | A | 1/1993 | Moore, Jr. et al. | |
| 5,735,237 | A * | 4/1998 | Phillip | F24H 1/206 122/18.5 |
| 6,036,480 | A * | 3/2000 | Hughes | F23D 14/24 122/249 |
| 7,316,206 | B2 * | 1/2008 | Akkala | F24H 1/205 122/18.1 |
| 7,415,943 | B2 * | 8/2008 | Missoum | F24H 1/287 122/18.1 |
| 7,559,293 | B2 | 7/2009 | Gordon et al. | |
| 7,958,852 | B2 * | 6/2011 | Kim | F22B 21/22 122/1 B |
| 7,971,560 | B2 * | 7/2011 | Gordon | F24H 1/205 122/15.1 |

(Continued)

FOREIGN PATENT DOCUMENTS

AU 2014202585 6/2014

OTHER PUBLICATIONS

International Search Report for PCT/US2018/036273, dated Sep. 27, 2018.

*Primary Examiner* — Gregory A Wilson

(74) *Attorney, Agent, or Firm* — King & Spalding LLP

(57) ABSTRACT

A water heater has a tank, a burner, and a heat exchanger within the tank interior volume that has three tubes. The burner exhausts gas into the first tube. The second tube is non-linear, and the third tube connects the first tube with the second tube. The cross-sectional area of the first tube is greater than the cross-sectional area of the third tube. The cross-sectional area of the third tube is greater than the cross-sectional area of the second tube.

27 Claims, 18 Drawing Sheets

(56) References Cited

U.S. PATENT DOCUMENTS

| | | | | |
|---|---|---|---|---|
| 8,161,918 | B2 * | 4/2012 | Ma | F24H 1/205 122/15.1 |
| 8,375,897 | B2 * | 2/2013 | Smith | F24H 1/206 122/13.3 |
| 8,763,564 | B2 * | 7/2014 | Abdel-Rehim | F24H 1/206 122/18.1 |
| 9,004,018 | B2 * | 4/2015 | Boros | F24H 1/18 122/13.01 |
| 10,024,574 | B2 * | 7/2018 | Lesage | F24H 8/00 |
| 2004/0011301 | A1 | 1/2004 | Gordon et al. | |
| 2010/0018475 | A1 * | 1/2010 | Arnold | F24H 1/206 122/18.1 |
| 2010/0043728 | A1 | 2/2010 | Ma et al. | |
| 2011/0214621 | A1 | 9/2011 | Boros et al. | |
| 2012/0090562 | A1 * | 4/2012 | Qiu | F23C 3/002 122/18.1 |
| 2018/0172316 | A1 * | 6/2018 | Smelcer | F24H 9/2035 |
| 2018/0224156 | A1 * | 8/2018 | Steinhafel | F24H 9/2035 |
| 2018/0292110 | A1 * | 10/2018 | Bernreuter | F24H 8/00 |

* cited by examiner

HIGH EFFICIENCY GAS-FIRED WATER HEATER

BACKGROUND OF THE PRESENT INVENTION

Various apparatus and methods are known for generating heat for contribution to water housed within a water heater tank by combustion of a mixture of fuel and air. In an example of such arrangement, a gas burner is disposed below the water tank in communication with a source of fuel and a source of air and an igniter so that, upon actuation of the igniter, the gas/air mixture combusts at the burner surface within an area, or burner box or combustion chamber, below the tank. The combustion heats the volume below the tank, allowing heat transfer through the tank floor into the tank's interior volume and the water contained therein. In addition, a flue pipe extends from the burner box up and through the tank volume to receive and allow passage of combustion exhaust gas through the tank. United States published patent application 2011/0214621, the entire disclosure of which is incorporated by reference herein for all purposes, discloses the use of a baffle disposed within the central flue pipe to facilitate transfer of heat from the exhaust gas to the flue pipe wall and, thereby, to water within the tank that surrounds the flue pipe. Rising through the flue pipe, the exhaust gas passes from the pipe at its top into a manifold disposed outside and above the tank. From the manifold, the gas passes into a secondary tube that extends back down through the top of the tank wall and back into the tank interior volume in parallel with the first flue pipe. Near the bottom of the inner tank volume, the tube turns and commences a coil around the primary flue pipe, thereby increasing the surface area of the secondary tube within the interior volume and correspondingly increasing the transfer of heat from gas flowing through the tube to the tube wall and thence to the water in the tank surrounding the tube. From the coil, the secondary tube extends outward through a side wall of the tank to a blower, which creates negative pressure to thereby draw the exhaust gas from the manifold, through the secondary tube, and out of the tank to a vent system. In another embodiment, the secondary tube is connected to the primary tube within the interior tank volume, before the primary tube extends through the top wall.

U.S. Pat. No. 7,559,293 discloses a gas-fired water heater with a down-fired combustion system comprised of a blower and a down-fired burner. The blower receives a mixture of fuel and air and pushes the mixture to a cylindrically-shaped burner that extends vertically downward into a vertical pipe that extends through the center of the water heater's interior volume. The center pipe extends down through the tank interior volume and the tank bottom wall to a collector. When an igniter is actuated, the fuel/air mixture ignites and combusts at the burner surface. The blower pushes exhaust gas vertically downward through the center pipe, allowing heat transfer from the exhaust gas through the center pipe wall and to water in the tank. The exhaust gas collects in the bottom collector and then rises through a plurality of pipes extending upward from the lower collector, through the bottom tank wall, through the top tank wall and to a second, upper, collector. From the upper collector, the exhaust gas passes back down through a second plurality of pipes extending through the upper tank wall, through the tank interior volume, through the bottom tank wall, and to a third, lower collector, from which the exhaust gas is vented from the system.

SUMMARY OF THE INVENTION

A water heater according an embodiment of the present invention has a tank that defines an interior volume for holding water. A burner is in communication with a fuel source and an air source. A first flue tube having a first cross-sectional area extends generally vertically into the interior volume and is disposed in communication with the burner so that an interior of the first flue tube receives exhaust fluid from combustion of fuel from the fuel source at the burner. A second flue tube is disposed within the interior volume and has a second cross-sectional area and a length. The second flue tube is non-linear along at least a portion of its length within the interior volume. A third flue tube has a third cross-sectional area and is attached in fluid communication with the first flue tube within the interior volume. The third flue tube is attached in fluid communication with the second flue tube within the interior volume and extends between the first flue tube and the second flue tube so that the exhaust fluid from the first flue tube flows to the second flue tube via the third flue tube. An interior surface of the third flue tube slopes toward the second flue tube over at least a portion of the third flue tube extending from its attachment to the second flue tube. An outlet extends through the tank from the interior volume to an area exterior of the tank. The second flue tube is connected to the outlet so that the exhaust fluid flows from the second flue tube through the outlet. The second flue tube is sloped toward the outlet over its length between the third flue tube and the outlet. The first cross-sectional area is greater than the third cross-sectional area. The third cross-sectional area is greater than the second cross-sectional area.

In a further embodiment, a water heater has a tank that defines an interior volume for holding water. A burner is in communication with a fuel source and an air source. A first flue tube has a first cross-sectional area that extends into the interior volume downward from the burner and is disposed in communication with the burner so that an interior of the first flue tube receives exhaust fluid from combustion of fuel from the fuel source at the burner. A second flue tube is disposed within the interior volume and has a second cross-sectional area and a length. The second flue tube is non-linear along at least a portion of its length within the interior volume. A third flue tube has a third cross-sectional area and is attached in fluid communication with the first flue tube within the interior volume. The third flue tube is attached in fluid communication with the second flue tube within the interior volume and extends within the interior volume between the first flue tube and the second flue tube so that the exhaust flue from the first flue tube flows to the second flue tube via the third flue tube. An interior surface of the third flue tube slopes toward the second flue tube over at least a portion of the third flue tube extending from its attachment to the second flue tube. An outlet extends through the tank through the interior volume to an area exterior of the tank. The second flue tube is connected to the outlet so that the exhaust fluid flows from the second flue tube through the outlet. The second flue tube is sloped toward the outlet over its length between the third flue tube and the outlet. The first cross-sectional area is greater than then third cross-sectional area. The third cross-sectional area is greater than the second cross-sectional area.

An embodiment of a method of manufacturing a fuel-fired storage type water heater having a fuel burner, a tank for holding water therein, and a flue disposed with respect to the burner to receive combustion gas therefrom and extending from proximate the flue, through an interior of the tank, to an outlet from the water heater includes defining a volume of water that will be stored in the interior, estimating a surface area of the flue, determining an initial geometric configuration of the flue, including internal cross-sectional area of the flue between the burner and the outlet, and modeling operation of the water heater based upon the defined volume, the estimated surface area, and the geometric configuration. Heat transferred from the flue to water in the volume during the water heater's operation is determined from the modeling step. The geometric configuration is repeatedly changed, and the modeling step is repeated for each changed geometric configuration. A geometric configuration is selected from the geometric configurations based on a minimization of surface area of the flue in the geometric configurations while maintaining at least a predetermined level of the heat transferred during the water heater's operation in respective modeling steps. A flue having the selected geometric configuration is assembled into a tank having the defined volume.

A further embodiment of a method of manufacturing a fuel-fired storage type water heater having a fuel burner, a tank for holding water therein, and a flue disposed with respect to the burner to receive combustion gas therefrom and extending from proximate the flue, through an interior of the tank, to an outlet from the water heater includes defining a volume of water that will be stored in the interior, estimating a surface area of the flue, determining an initial geometric configuration of the flue, including internal cross-sectional area of the flue between the burner and the outlet, and modeling operation of the water heater based upon the defined volume, the estimated surface area, and the geometric configuration. Heat transferred from the flue to water in the volume during the water heater's operation is determined from the modeling step. The geometric configuration is repeatedly changed, and the modeling step is repeated for each changed geometric configuration. A geometric configuration is selected from the geometric configurations based on an optimization of surface area of the flue in the geometric configurations and an optimization of heat transferred during the water heater's operation in respective modeling steps. A flue having the selected geometric configuration is assembled into a tank having the defined volume.

The accompanying drawings, which are incorporated in and constitute a part of this specification, illustrate one or more embodiments of the present invention.

BRIEF DESCRIPTION OF THE DRAWINGS

Aspects of the present invention can be better understood with reference to the following drawings. The components in the drawings are not necessarily to scale. An enabling disclosure of the present invention, including the best mode thereof, is set forth in the specification, which makes reference to the appended drawings in which.

Figure 1:
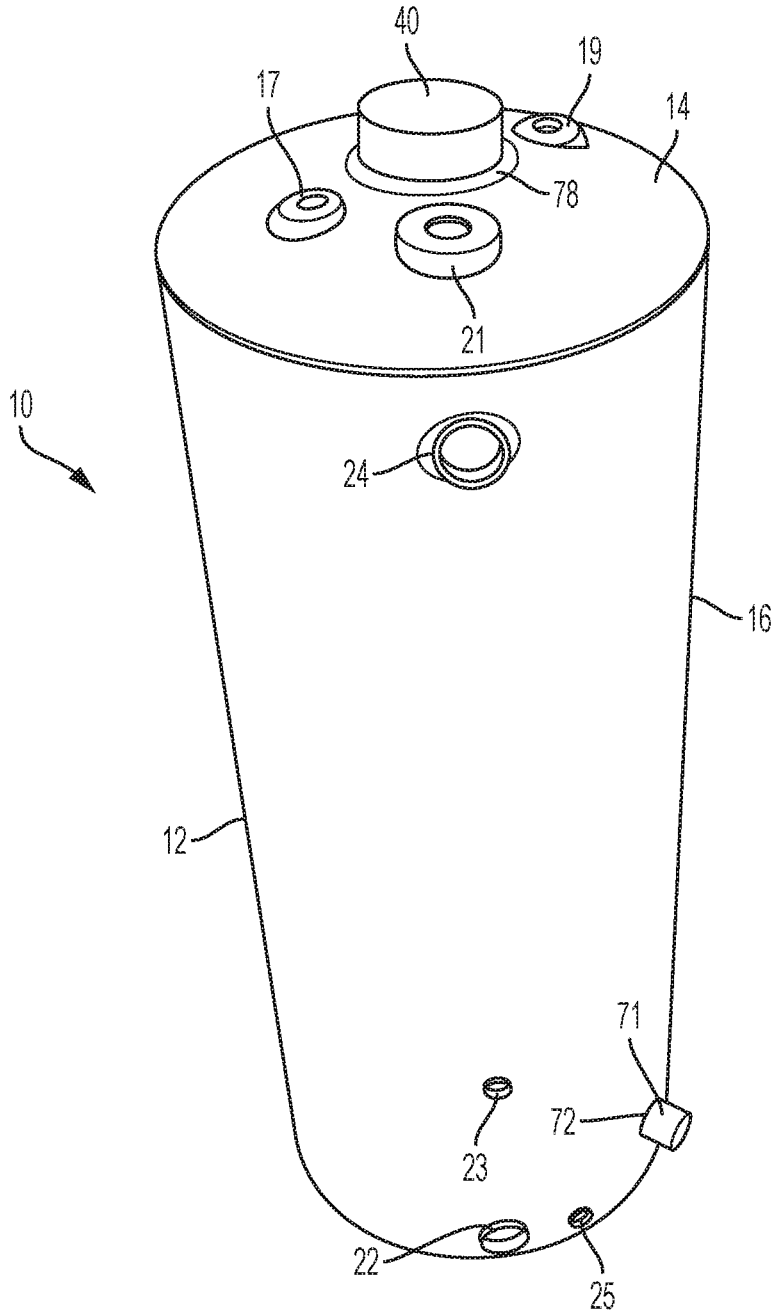
FIG. 1 is a partial perspective view of a gas-fired water heater according to an embodiment of the present invention.

Repeat use of reference characters in the present specification and drawings is intended to represent same or analogous features or elements of embodiments of the present invention.

DETAILED DESCRIPTION OF ONE OR MORE EMBODIMENTS

Reference will now be made in detail to certain embodiments of the present invention, one or more examples of which are illustrated in the accompanying drawings. Each example is provided by way of explanation of the invention, not limitation of the invention. In fact, it will be apparent to those skilled in the art that modifications and variations can be made in such examples without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The term "or" as used in the specification and appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an" and "the" may include plural references, and the meaning of "in" may include "in" and "on."

The phrase "in one embodiment," as used herein does not necessarily refer to the same embodiment, although it may.

Various aspects or features will be presented in terms of systems that may include a number of devices, components, modules, and the like. It is to be understood and appreciated that the various systems may include additional devices, components, modules, etc. and/or may not include all of the devices, components, modules, etc. discussed in connection with the figures. A combination of these approaches may also be used.

Figure 4:
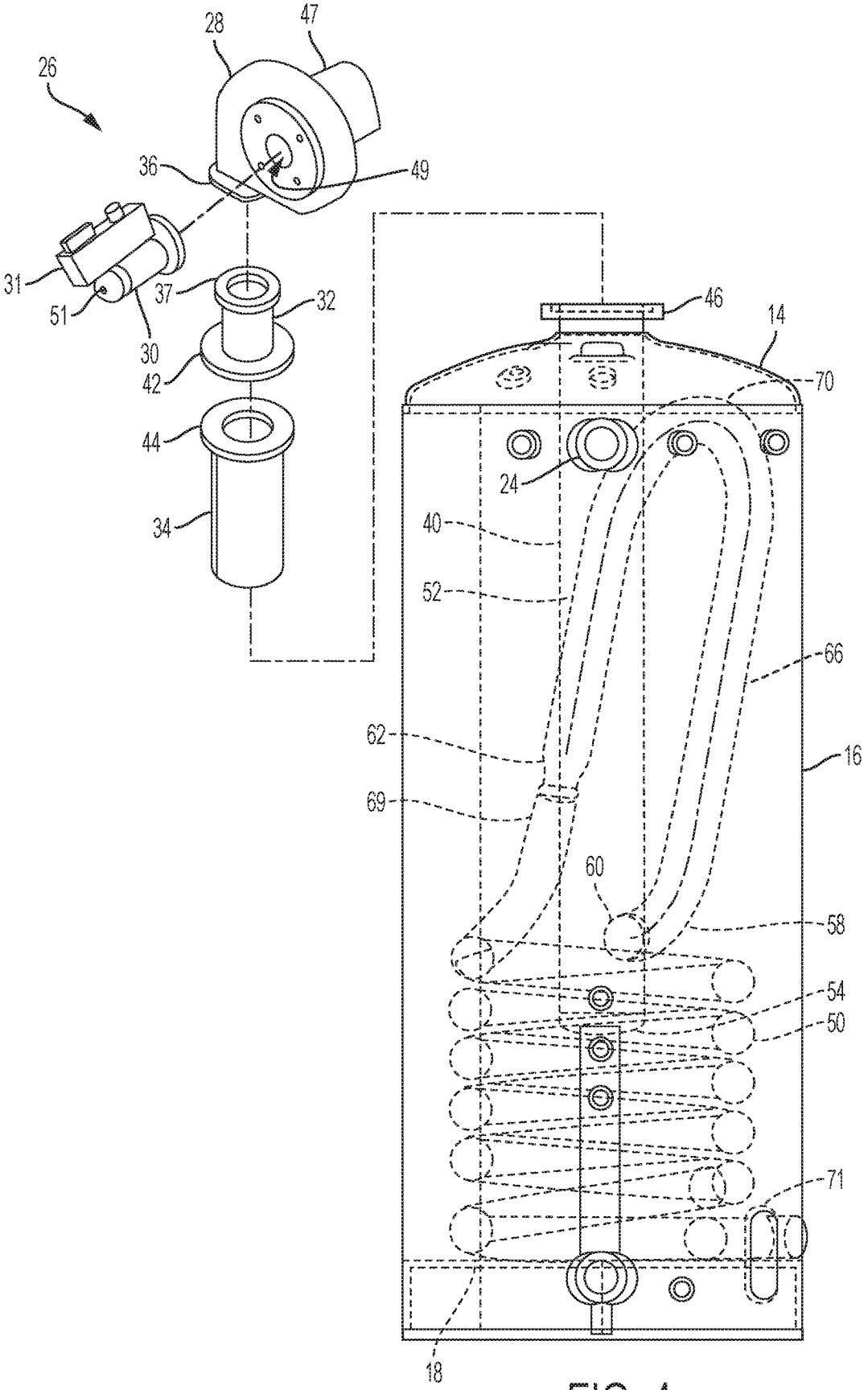
FIG. 4 is a side view of the gas-fired water heater as in FIG. 1, illustrating a premix burner assembly in exploded view.
Figure 5:
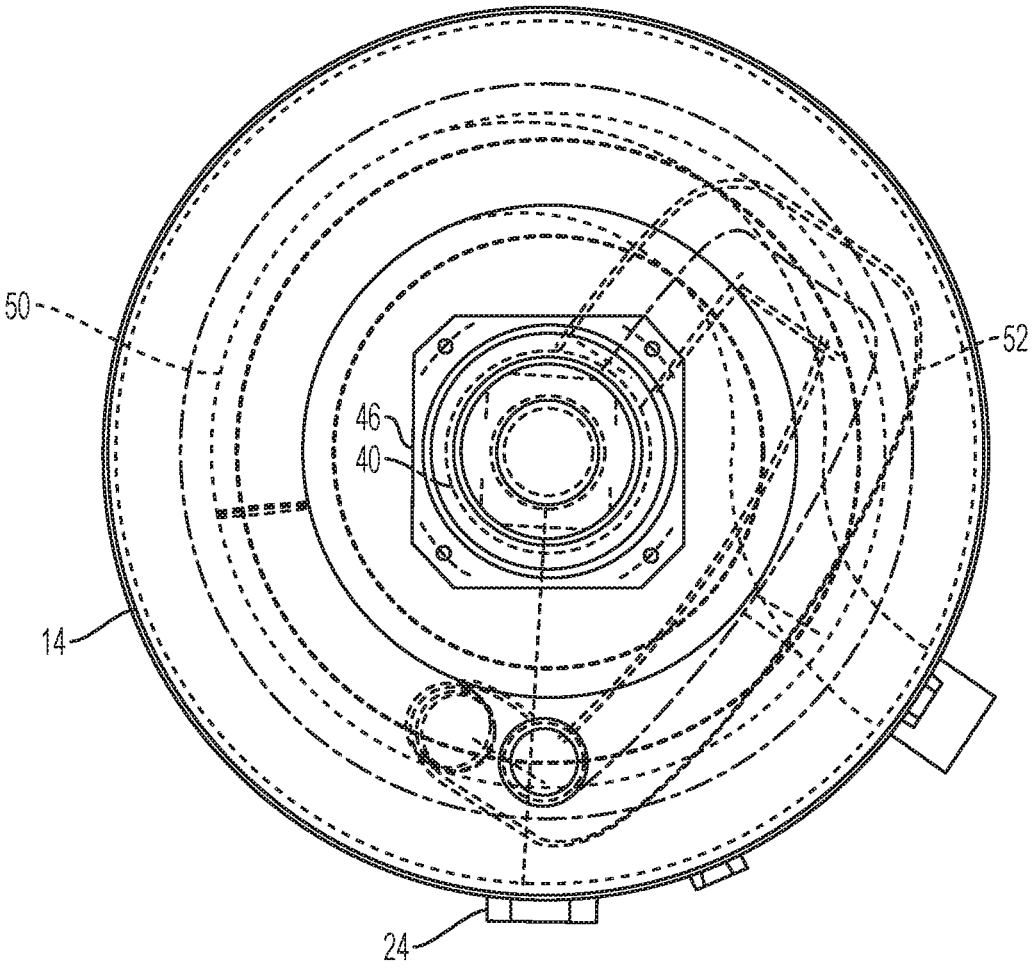
FIG. 5 is a top view of the gas-fired water heater as in FIG. 1.
Figure 6:
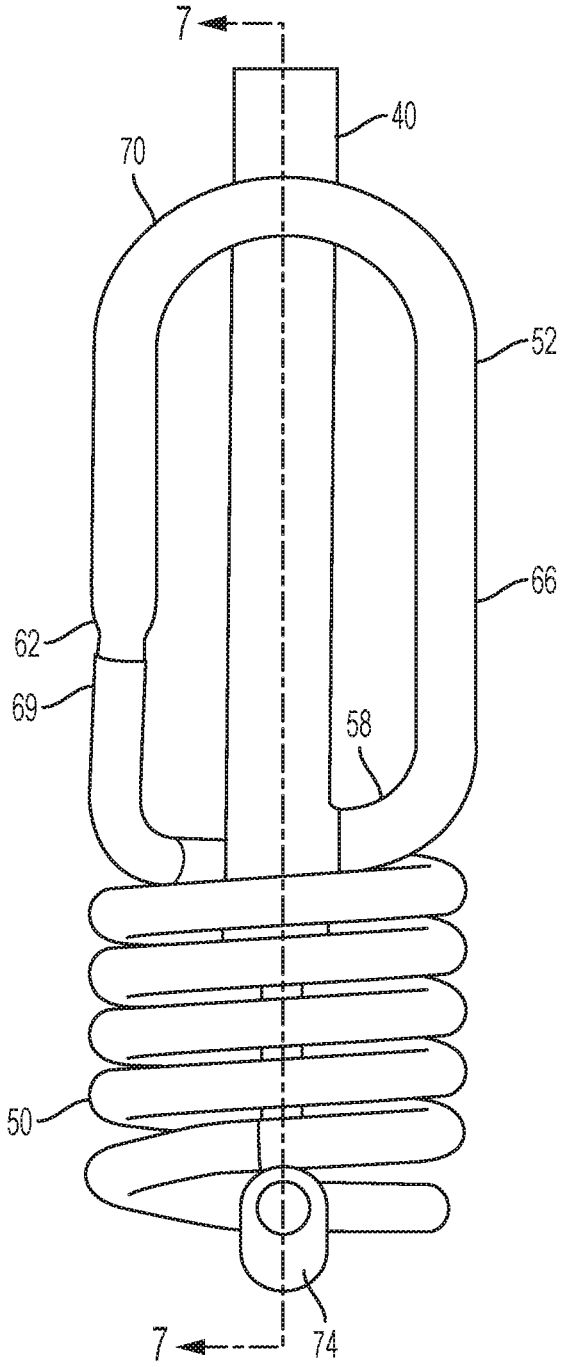
FIG. 6 is a side view of a flue tube system of the gas-fired water heater as in FIG. 1.
Figure 7:
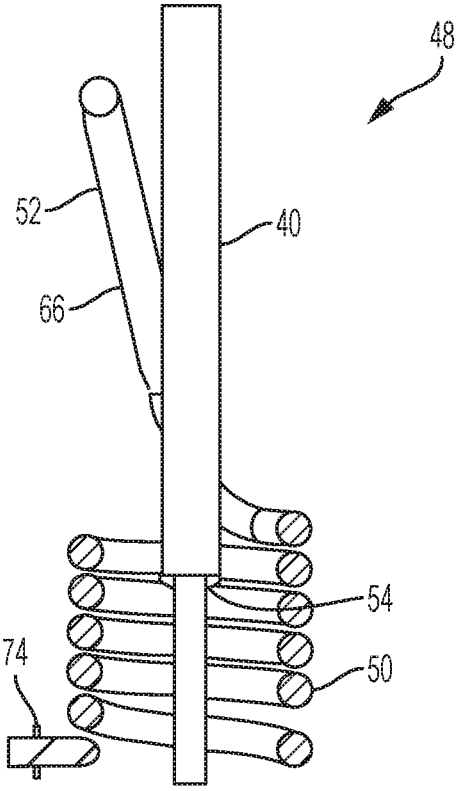
FIG. 7 is a partial front view of the flue tube assembly as in FIG. 6.
Figure 8:
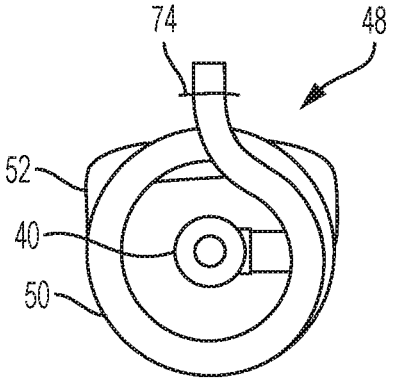
FIG. 8 is a bottom view of the flue tube assembly as in FIG. 6.

Further, terms referring to a direction or a position relative to the orientation of the water heater, such as but not limited to "vertical," "horizontal," "upper," "lower," "above," or "below," refer to directions and relative positions with respect to the water heater's orientation in its normal intended operation, as indicated in FIG. 4 and in the perspective view of FIG. 1. Thus, for instance, the terms "vertical" and "upper" refer to the vertical orientation and relative upper position in the perspective of FIG. 4 and, in the perspective view of FIG. 1, and should be understood in that context, even with respect to a water heater that may be disposed in a different orientation.

Figure 2:
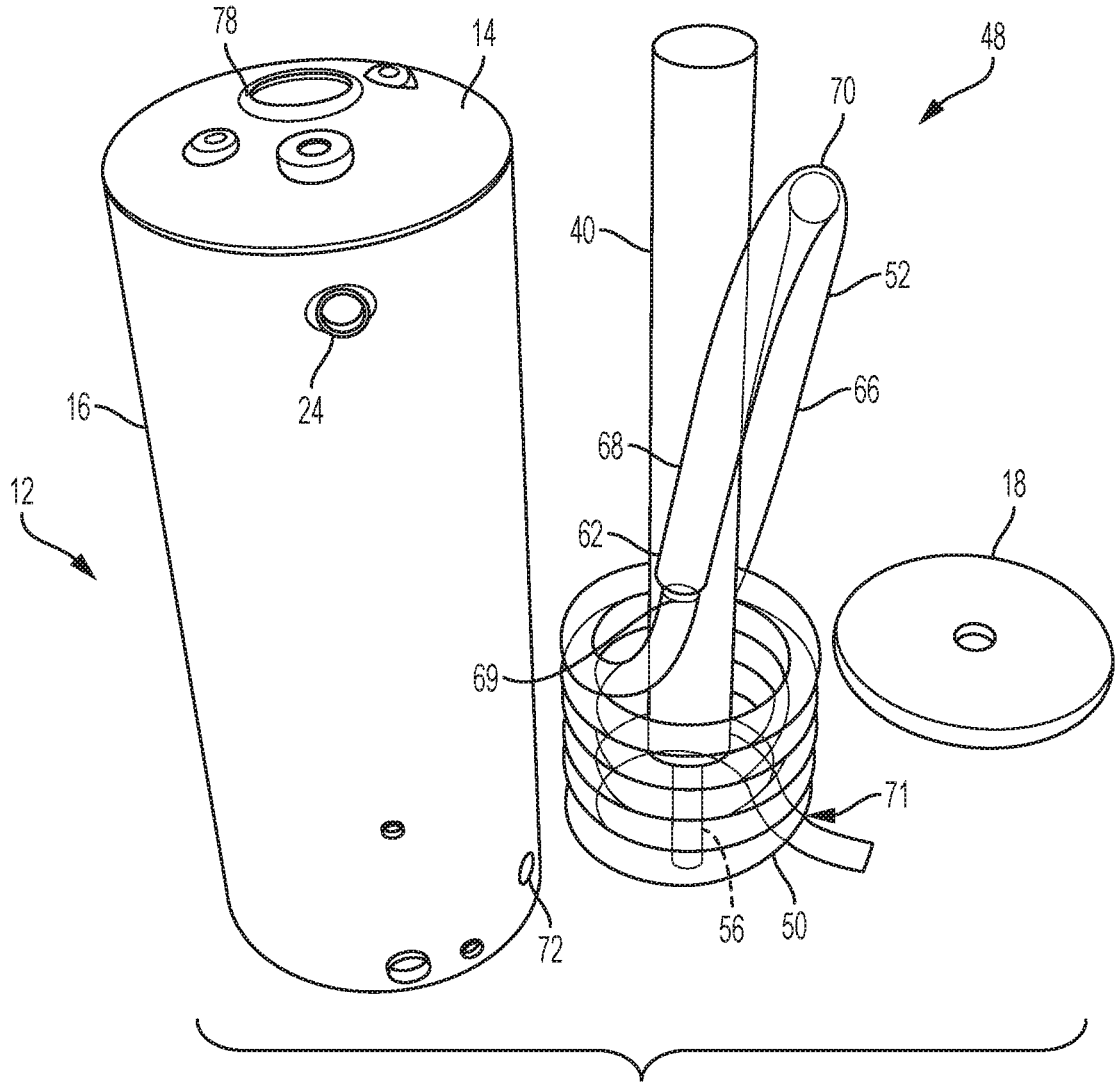
FIG. 2 is a partial exploded view of the gas-fired water heater as in FIG. 1.
Figure 3:
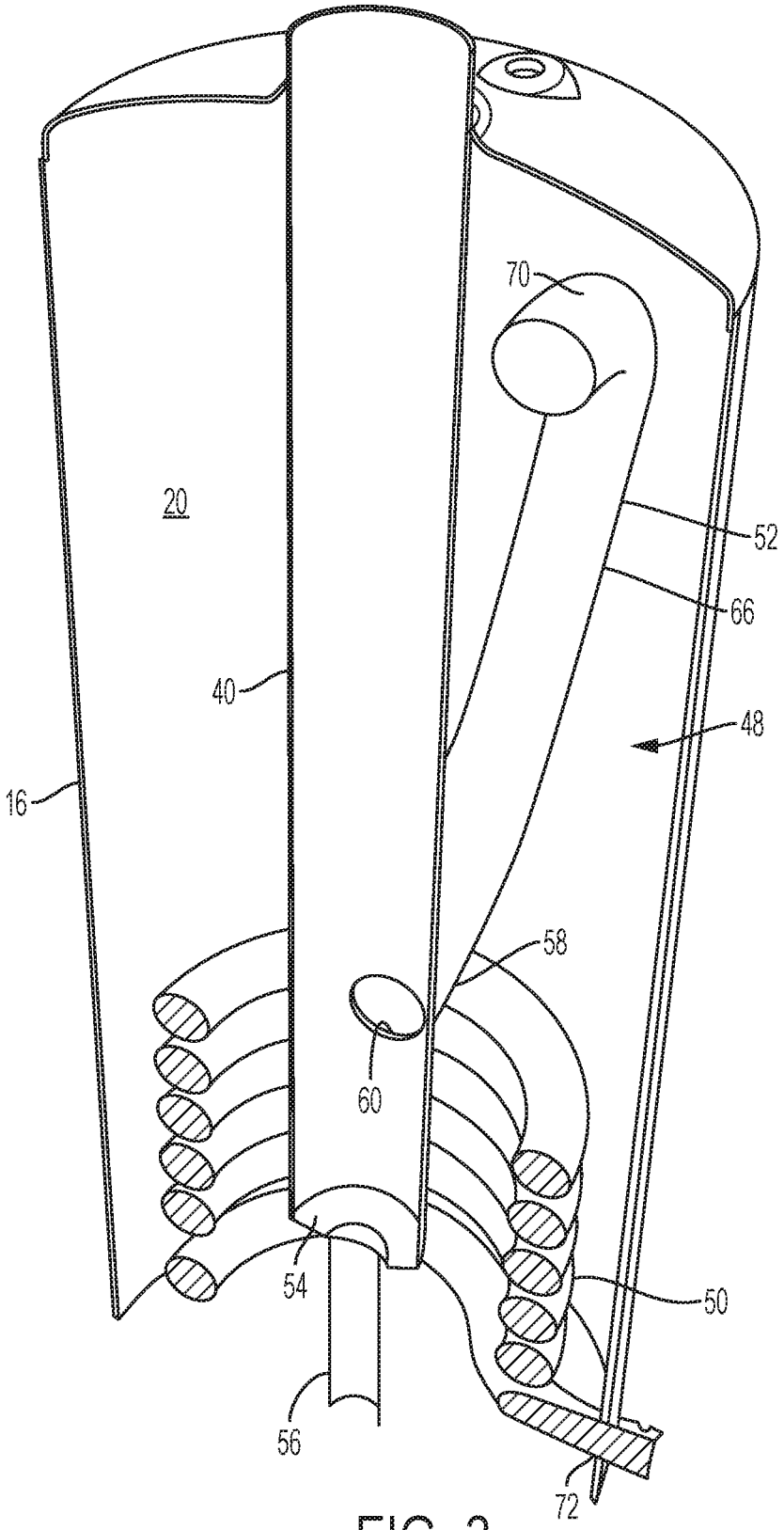
FIG. 3 is a partial sectional view of the gas-fired water heater as in FIG. 1.

Referring now to FIG. 1, a water heater 10 includes a vertically oriented, generally cylindrical water tank body 12. Body 12 is defined by a domed top wall, or head, portion 14, a cylindrical side wall portion 16, and a bottom wall portion 18 (FIG. 2). Side body wall 16, top wall 14, and bottom wall 18 generally define an interior volume 20 (FIG. 3) for storing water therein. In presently described embodiments, volume 20 holds approximately 100 gallons of water (after insertion of heat exchanger 48 as described below), though it should be understood that this is for example only and that the water heater capacity can vary. Side wall 16, top wall 14, and bottom wall or floor 18 may be formed from materials common to the construction of water heaters, for example a carbon steel outer wall layer with a glass or porcelain enamel inner surface, or uncoated stainless steel. Raised mounting shoulders 17 and 19 support mounting fixtures for anodes that extend through center holes through the shoulders into the water heater interior. A shoulder 21 supports a mounting fixture for a thermostat that extends through a center hole through the shoulder to measure water temperature in the upper part of the water heater. A mounting shoulder 23 supports a second thermostat that extends through a center hole through side wall 16 to measure water temperature in the lower part of the water heater. A fitting 25 allows the mounting of a drain valve at the tank's bottom.

A cold water inlet fitting 22 extends through side wall 16 at the bottom portion of tank body 12. Fitting 22 is configured to sealingly attach to a cold water inlet line that fluidly connects to and thereby draws water from a municipal cold water system. As should be understood, such a municipal cold water source will be under pressure, so that as water is removed from tank 12, the municipal water source line moves cold water into interior volume 20 through fitting 22. A hot water outlet fitting 24 extends through side wall 16 of tank 12 at an upper portion of the tank. Fitting 24 is configured to sealingly attach to a hot water line that extends into the residential or commercial building in which water heater system 10 is located. This hot water line (not shown) leads to the hot water lines of appliances and faucets throughout the building.

It will be noted that the hot water outlet fitting is disposed at the top of the tank, whereas the cold water inlet fitting is at the bottom. Since cold water is denser than warmer water, warmer water within a hot water heater will be nearer the top of the tank unless the tank includes a mechanism for constantly mixing water within the tank.

Referring to FIGS. 1-4, water housed within interior volume 20 is heated by heat provided by a premix burner system 26 that comprises a blower 28, an air intake Venturi tube 30, a gas input valve 31, an output tube 32, and a burner 34. Blower 28 defines a flange 36 that surrounds the output of the blower and that attaches to a mating flange 37 at an upper end of output tube 32. At the opposite end of tube 32 is a flange 42 that fits flush against an opposing flange 44 of burner 34. Blower flange 36 attaches to opposing flange 37 at the upper end of output tube 32, and flange 42 at the lower end of output tube 32 attaches to upper flange 44 of burner 34 by screws, rivets or other suitable means, so that blower 28, output tube 32, and burner 34 form a modular assembly that may be attached to, and be a part of, water heater 10. More specifically, and with reference to FIG. 4, premix burner system 26 attaches, at flange 42 of output tube 32 via flange 44 of the burner, to a flange 46 of a center combustion tube 40 that extends downward into tank volume 20. Flanges 42, 44, and 46 may be attached to each other by any suitable means, for examples screws or rivets. Gaskets may be disposed between opposing flanges of the various components of the burner system and combustion tube 40. An igniter (not shown) is mounted to and extends downward from flange 44 of burner 34 into the interior of combustion tube 40 and proximate the outer surface of burner 34.

In operation, a control system (not shown) selectively actuates valve 31, blower 28, and the igniter in response to temperature of water within tank volume 20. The control system may comprise a temperature sensor, such as a thermistor, disposed on one of the walls, for example side wall 16, of water tank 12 opposite interior volume 20 so that the temperature sensor detects a temperature of water within the tank and outputs a signal corresponding to the temperature. A controller, for example comprising one or more processors or other computing device(s), receives the signal and executes computer-executable program instructions, for example a software program, that are configured to, when executed by the controller, compare the water temperature indicated by the signal to a predetermined low set point or a predetermined high set point temperature, depending on present conditions. For example, at start up or otherwise if the burner is inactive, the controller determines the water temperature from the sensor signal and compares that temperature to the low set point. If the water tank water temperature is above the low set point, the controller takes no immediate action and continues to continuously or intermittently detect the temperature signal. If, at startup or from an inactive state of the burner/water heater, the temperature corresponding to the temperature signal is below the low set point, or if the temperature represented by the temperature signal falls below the low set point after initially being above the low set point, a condition exists at which heat should be contributed to the tank water. Accordingly, the controller outputs a signal to one or more relays/switches that causes the relays/switches to electrically connect an electrical power source to valve 31, blower 28 (and, more particularly, a motor 47 that drives a squirrel cage rotor in blower 28), and the igniter, thereby actuating these three components.

Valve 31 receives a flow of gas or other fuel from a pressurized natural gas line (not shown) attached to the valve. The valve's actuation causes the valve, which may be solenoid-driven in response to a signal from the controller via a relay, to open, thereby allowing the gas to flow through the valve and into an interior chamber of intake Venturi tube 30. Intake Venturi tube 30 is upstream from blower 28. An output end of the intake tube is received by and opens into an input port 49 of blower 28, so that the blower's actuation draws an air flow through an open input end 51 of tube 30, through the intake tube's interior chamber and input port 49, and into the blower's interior. Thus, the Venturi tube has two fluid inputs, a fuel source and an air source. The injection of gas into this air flow via valve 31 mixes the fuel with the air to a ratio determined by the gas pressure and flow rate, the degree to which valve 31 opens, the configuration of tube 30, and the speed and capacity of blower 28. Blower 28 pushes the resulting fuel/air mixture from its output opening and through output tube 32 into the interior volume of the hollow, cylindrical body of burner 34. The burner body can be made in various configurations, e.g. a mesh, a sheet-like structure having a plurality of through-holes about the body, or a solid, non-porous sheet-like structure with an opening at its distal end. The pressurized fuel/air mixture within the body's interior therefore flows from the interior and through the cylindrical burner body to a volume immediately exterior thereof. Accordingly, the actuation of the igniter causes ignition of the fuel/air mixture at the burner, the body of which can be considered a flame holder. Continued operation of the blower pushes heated exhaust fluid, at this stage a gas, downward into and through the interior volume of combustion tube 40, which extends generally vertically downward into interior volume 20 of the water tank. Thus, combustion tube 40 may also be considered a flue tube.

The controller continues to monitor the tank water temperature represented by the temperature sensor signal during the operation of burner system 26. After actuation of the burner system and during its operation, however, the controller continuously or intermittently compares the water tank water temperature to the high set point. When the controller detects that the water tank water temperature has reached the high set point, the controller causes the relay/switch that delivers power to blower 28 to disconnect the power source from the blower, thereby ending the delivery of electric current to the blower motor. This, in turn, ends the delivery of fuel to the burner, thereby ending combustion at the burner and the delivery of heated gas down into combustion tube 40. Upon this deactivation of the burner assembly, the controller continues to monitor the temperature represented by the temperature sensor, continuously or intermittently, comparing the sensed temperature again to the low set point, and the cycle repeats.

A flame sensor (not shown) may also be mounted to flange 44 of burner 34 and extend into the interior of combustion tube 40 proximate the burner surface. The flame sensor outputs a signal to the controller, indicating detection of a flame at the burner surface. While the processor actuates burner system 26, the controller monitors the output of the flame sensor and continues operation of the system as long as the signal indicates presence of a flame. If, however, burner system 26 is actuated, in that blower 28 is actuated to provide a fuel/air mixture to the burner, and the signal from the flame sensor indicates absence of a flame, the controller deactivates blower 28. Processes for operation in such circumstances, or otherwise when detecting faults, should be well understood and are not discussed further herein.

Still referring to FIGS. 1-5, and additionally to FIGS. 6-10, a heat exchanger 48 is formed by combustion tube 40, a condenser tube 50 and transition tube 52, all in fluid communication with each other. In the illustrated embodiments, all three tubes are circular in cross-section, but this should be understood to be only by way of example and that the tubes could have other configurations. In the example embodiment of a 100 gallon tank illustrated in these figures, heat exchanger 48 is configured to receive heat from burner system 26 at a rate of 200,000 Btu/hr (British thermal unit per hour), though it should be understood that the rate and heat exchanger configuration will vary with variation in tank capacity. In making such variations in the heat exchanger, as described in more detail herein, factors such as heat flux (in particular, avoiding local surface temperature spikes over the heat exchanger surface), pressure drop (in particular, minimizing gas flow pressure drop through the heat exchanger), and heat exchanger surface area (in particular, minimizing the heat exchanger surface area needed to attain energy efficiency targets) are considered in one or more presently described embodiments. Combustion tube 40 is circular in cross-section, for example defining an initial cross-sectional area between about 19 square inches and about 23 square inches, and defines a constant internal-diameter cross-sectional area from its upper end, at flange 46, to its closed lower end at a bottom wall 54. A post 56 is welded to bottom wall 18 of tank body 12 and supports tube 40 in its position in tank body 12. Combustion tube 40 is made of cold-rolled, low carbon (C1010) steel, has a wall thickness of about 0.160 inches and is at least about five inches in external diameter, in order to accommodate the width of burner 34, the size of which is therefore a limiting factor for the diameter of combustion tube 40. It should be understood that different materials and wall thicknesses could be used. As described below, the external diameter of tube 40, in this embodiment, has been optimized to a diameter of about five and one-half inches (for an internal diameter of about 5.18 inches).

Transition tube 52 is made of cold-rolled, low carbon steel, with a wall thickness of about 0.070 inches, and defines a constant-diameter internal-diameter cross-sectional area, for example between about three square inches to about ten square inches, from a first end 58 welded to tube 40 at a hole 60 therein so that an interior volume of tube 52 is in fluid communication with the interior volume of tube 40, to an opposite end 62, at which the diameter of transition tube 52 reduces so that the distal portion of end 62 can be received by condensing tube 50. The inner surface of transition tube 52 is covered with a porcelain enamel coating to prevent damage to the steel tubing from condensation in the event the dew point is reached while the combustion gas is in the transition tube. No porcelain coating is provided in combustion tube 40, in that the high temperatures of the exhaust gas in the combustion tube preclude the gas from reaching the dew point and could, in any event, damage such a coating. Transition tube 52 extends into an upper half of volume 20. Transition tube 52, in this embodiment, has a minimum (external) diameter of about three inches and, as discussed below, is optimized in diameter in this embodiment to about three and one-half inches (or, an internal diameter of about 3.36 inches).

Combustion tube 40 defines a length of about forty inches between burner 34 and hole 60. From hole 60, transition tube 52 curves into a straight section 66 having a center line that forms an angle of about twelve and one-half degrees to a vertical center line defined by tube 40. At its top, transition tube 52 curves at 70 at a radius of approximately 8.125 inches (measured from its center of curvature to the tube's center line through the tube volume) to a second straight section 68 having a center line parallel to the center line of section 66. Top curved section 70 passes through inner volume 20 of tank 12 proximate hot water output fitting 24. The vertical height of the apex of top curved section 70 above the floor of tank volume 20, and therefore the height of condenser tube 50 and transition tube 52, in certain embodiments is at least 80% of the vertical height of tank volume 20 and, in certain other embodiments at least 90% of the tank volume's height.

Figure 9:
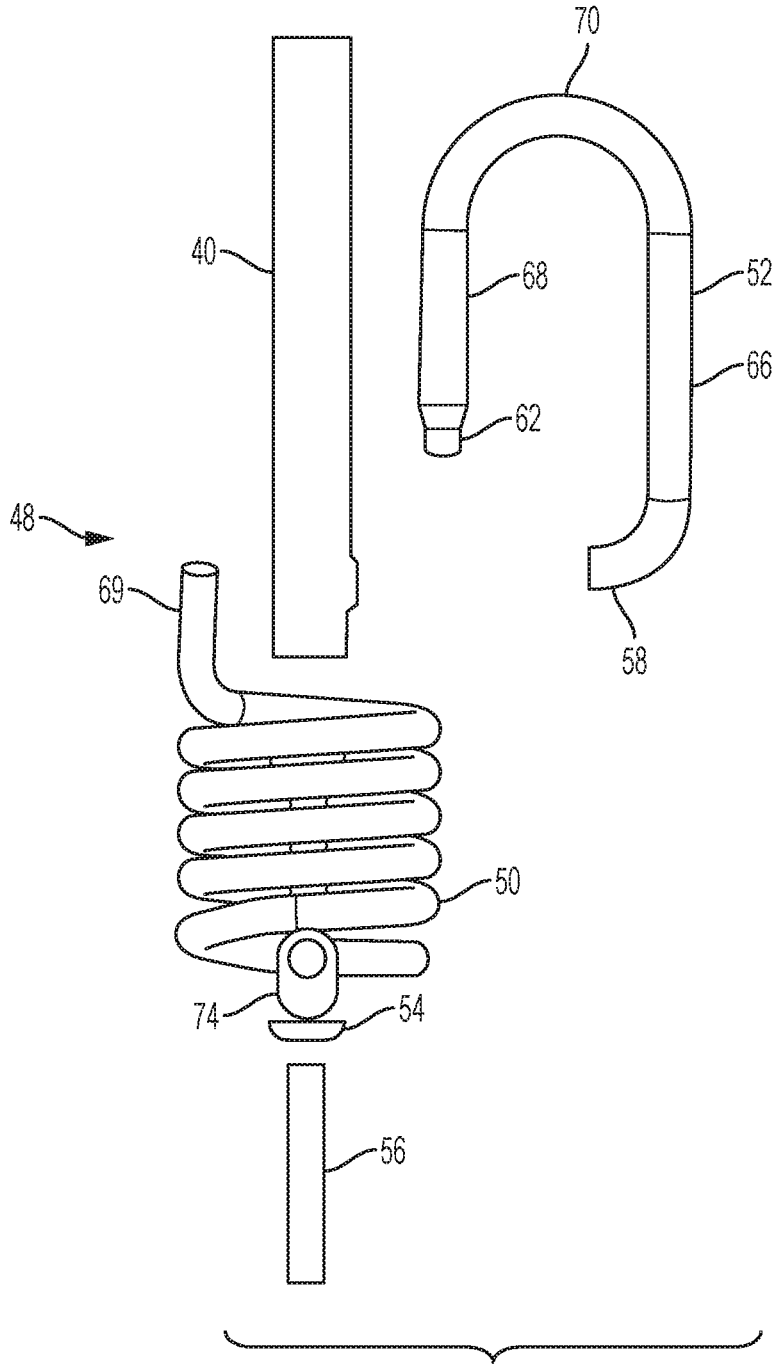
FIG. 9 is an exploded view of the flue tube assembly as in FIG. 6.
Figure 10:
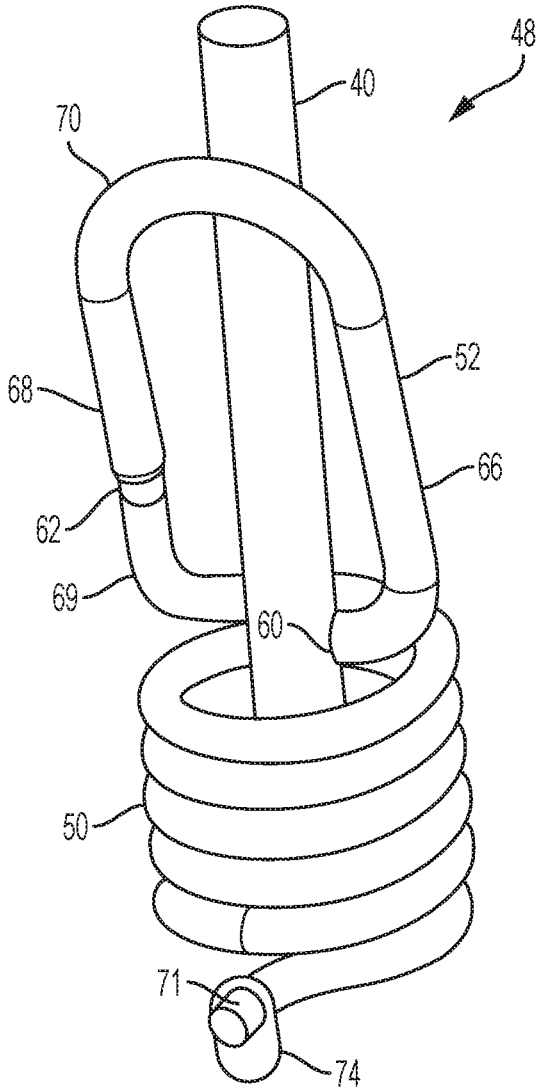
FIG. 10 is a perspective view of the flue tube assembly as in FIG. 6.

Condenser tube 50 is made of cold-rolled carbon steel, with a wall thickness of about 0.050 inches and a porcelain enamel coating on the tube's inner surface to protect the tube's steel from corrosion due to condensation of the exhaust gas. Tube 50 defines an internal cross-sectional area that is circular, for example from about three square inches to about seven square inches, although it should be understood that oval or other geometries could be used. In the illustrated embodiment, the diameter of the (external) cross section is approximately two and one-half inches, and in other embodiments may have a diameter in the range of about two inches to about three inches or from about two and a half inches (or, an internal diameter of about 2.4 inches) to about three inches (or, an internal diameter of about 2.9 inches). The coil section of tube 50 defines four and one-half turns at a pitch, or distance between turns, of about three inches. The length of tube 50, measured along a longitudinal center line normal to the internal cross-sectional area, extending from an end 69 at which condenser tube 50 attaches to intermediate tube 52 to an end 71 at which coiled condenser tube 50 passes through a hole 72 in tank side wall 16, is about sixteen inches. In the illustrated embodiments, tube 50 is disposed entirely in the bottom half of tank volume 20. The connection between tube 50 and tube 52 is in the bottom half of volume 20. Referring also to FIGS. 9 and 10, a flange 74 is fixed about the perimeter of end 70 of tube 50. Flange 74 is sealed about hole 72 (FIG. 2) in tank side wall 16, thereby maintaining a water tight enclosure of interior volume 20. Tubes 40, 50, and 52 may be attached to each other, as indicated in the Figures, by welding or other suitable means.

As described below, the length and cross-sectional diameter of tube 50 is determined through an optimization process that minimizes the use of metal in the tube (i.e. thereby tending to minimize the length and cross-sectional area, while also maximizing the heat flux over the length of the tube up to a maximum heat flux at which damage may occur to the tube (i.e. thereby tending to maximize the length and cross-sectional area, at least until the maximum heat flux is reached at some point along the tube's length). In the illustrated examples, the tube's length, and therefore the number of coils and the coil pitch, is also limited by the height and diameter of internal tank volume 20 (which, as should be understood, may be bounded by regulations relating to the size of the tank), the need for space in which to dispose transition tube 52, and the need to maintain at least a sufficient distance between the coils to permit water flow between them (to facilitate heat transfer to the water and away from the tube wall).

While the illustrated embodiments have only one each of tubes 40, 50, and 52, it should be understood that multiple tubes in one or more of the three stages may be used. Also, while tube 50 is illustrated as a coil, it should be understood that other geometrics could be used.

Blower 28 is sufficiently strong that the blower moves the exhaust gas (and, following condensation in tube 52 and/or tube 50, liquid) entirely through the heat exchanger and out of end 71 of tube 50. A condensate trap following end 71 separates liquid from any remaining exhaust gas, with the condensate running to a sump and the gas vented through an exterior flue pipe out of the building.

In those embodiments in which the burner is disposed below floor 18, the combustion tube extends vertically upward from a center hole through floor 18 and extends to or almost to top wall 14. Struts between top wall 14 and the combustion tube stabilize the combustion tube's position in volume 20. Condenser tube 52 is again formed in a coil in the bottom portion of volume 20, similar to its arrangement in the present Figures. Transition tube 52, however, extends from a hole at or near the top of the combustion tube and extends down to a connection to tube 50 as shown herein. The burner in such an arrangement may be a premix burner, similar to that shown in FIG. 4, that pushes the exhaust gas up through the combustion tube, through the transition tube, and through the condenser coil. As in the illustrated embodiments, a condensate trap follows the output of the condenser coil, separating the exhaust condensate from the remaining exhaust gas and venting the gas out of the building through a flue pipe.

Figure 11:
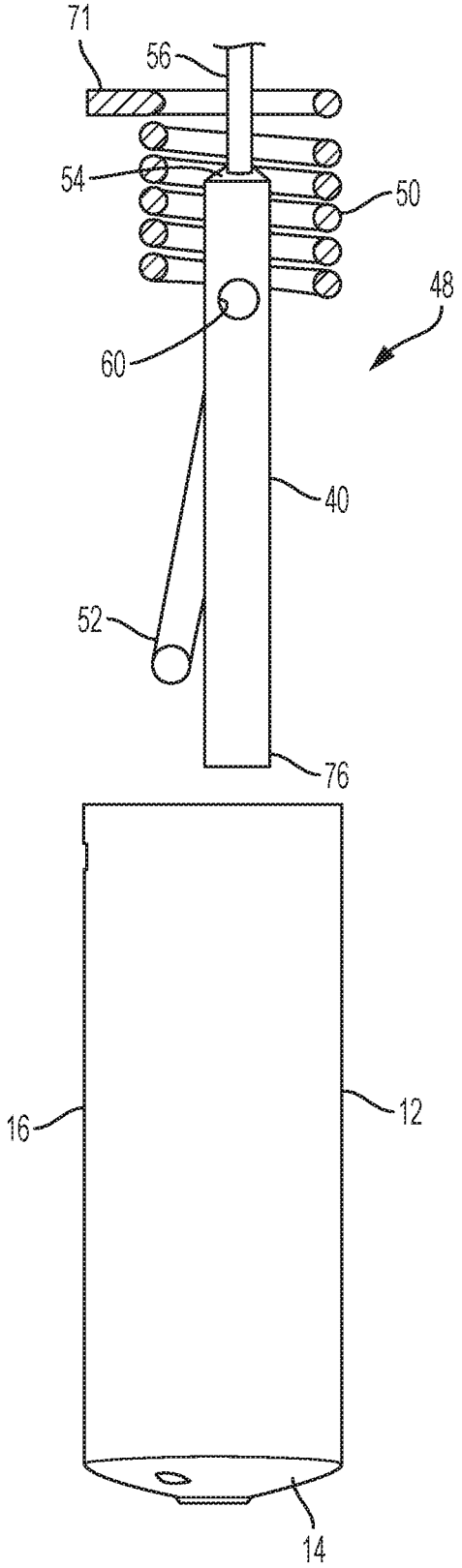
FIG. 11 is a partial exploded view, partly in section, of the gas-fired water heater as in FIG. 1.

FIGS. 11-16 illustrate assembly of water heater system 10 (FIG. 1). Referring initially to FIG. 11, water tank 12 is inverted, so that top wall 14 is in the lowest position, and bottom wall 18 is not yet assembled to the tank. Combustion tube 40, transition tube 52, and condenser tube 50 are assembled and welded together so that the three tubes form a coherent assembly.

Figure 12:
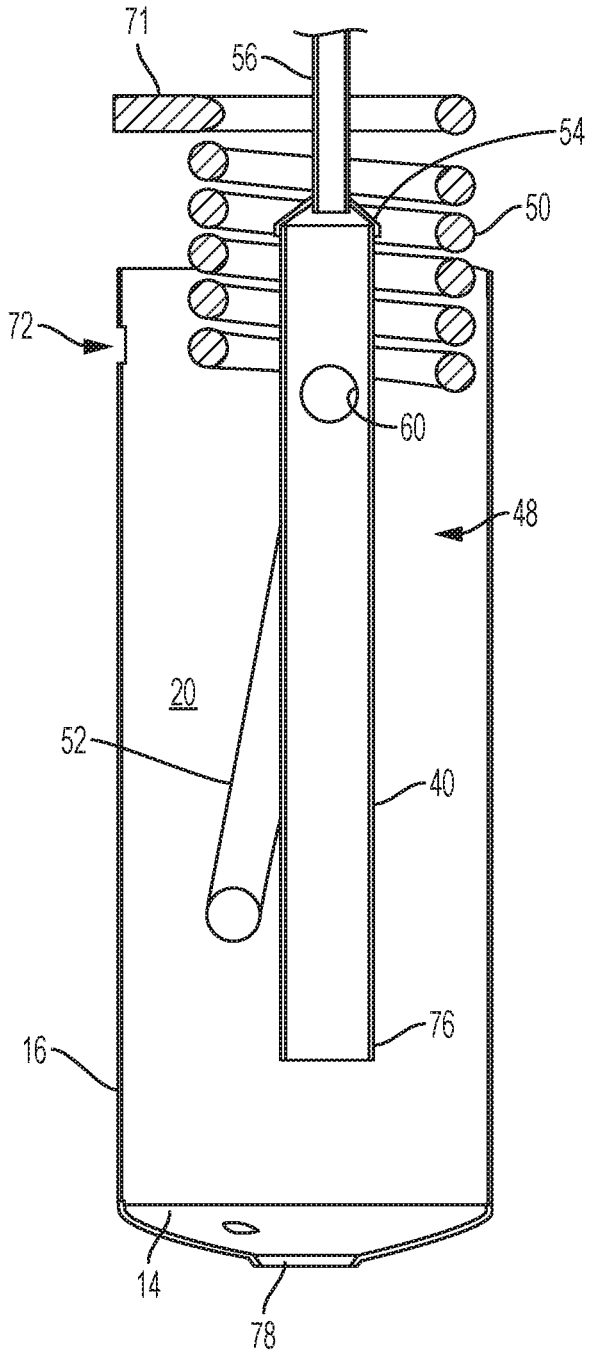
FIG. 12 is a partial exploded view, in section, of the gas-fired water heater as in FIG. 1.
Figure 13:
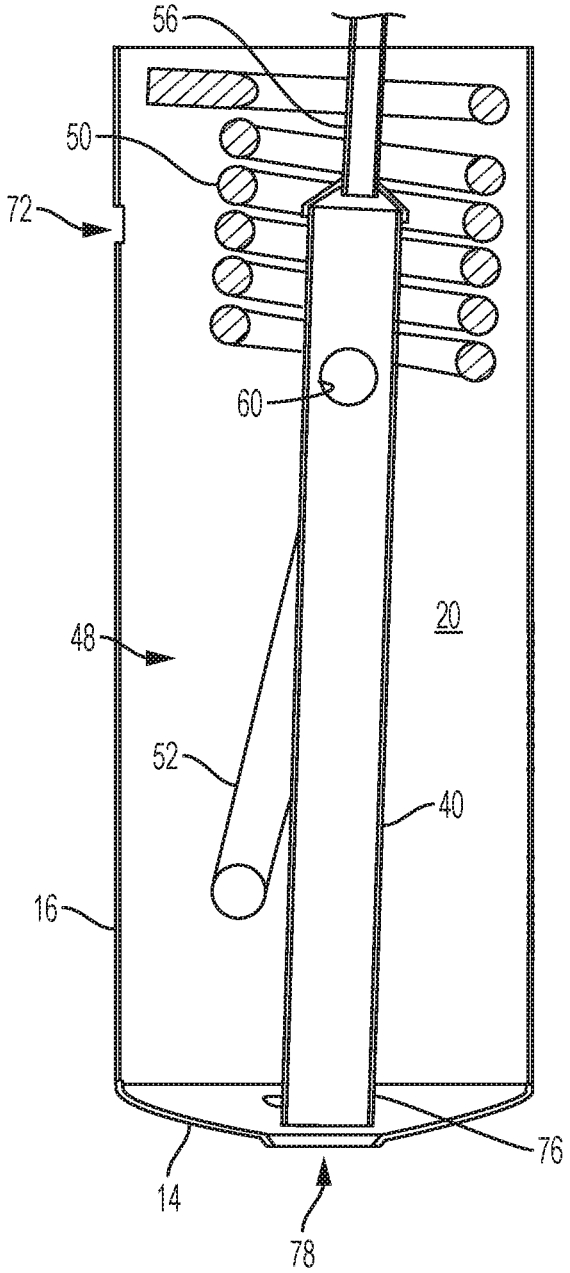
FIG. 13 is a partial exploded view, partly in section, of the gas-fired water heater as in FIG. 1.
Figure 14:
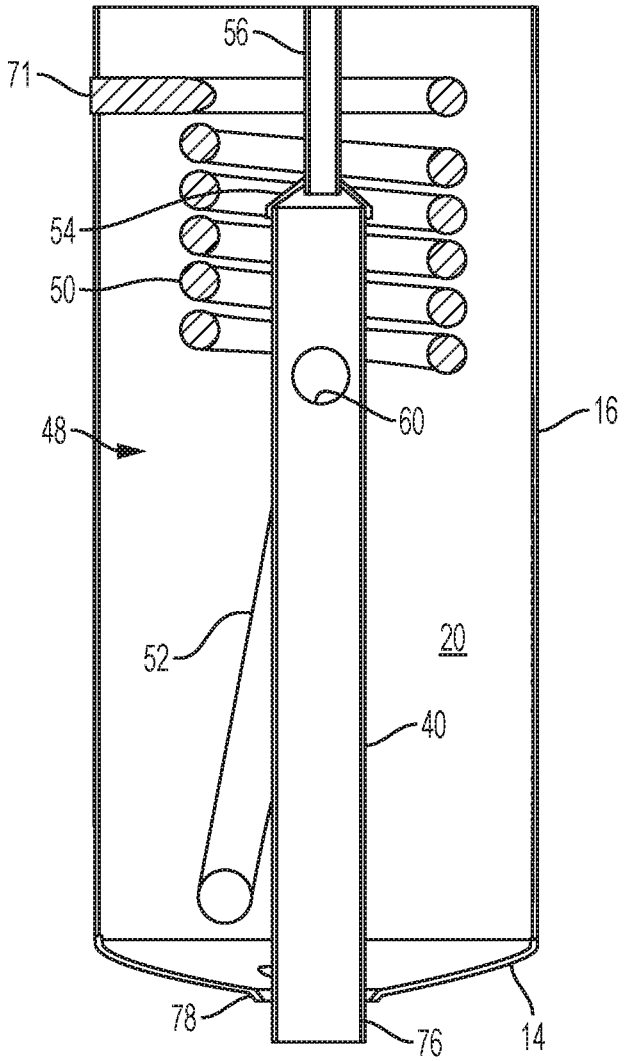
FIG. 14 is a partial side view, partly in section, of the gas-fired water heater as in FIG. 1.

At FIGS. 12-14, flue assembly 48 is moved downward into volume 20 of tank 12 until an upper end 76 of combustion pipe 40 is adjacent a center through-hole 78 in top wall 14 and end 71 of tube 50 is adjacent hole 72 in tank wall 16. At FIG. 14, top end 78 of tube 40 and end 71 of tube 50 are simultaneously pushed through holes 78 and 72, respectively, thereby aligning assembly 48 in its proper position in and with respect to tank 12. Exhaust flange 74 may later be inserted over end 71, to hold end 71 in place, and welded to the tank body. This allows the welding to take place away from tube 50, thereby avoiding melting of its interior porcelain enamel. For this purpose, a surrounding flange may be welded to the tank wall to receive flange 74 for welding. Patches may be disposed between the outer edge of end 71 of pipe 50 and the inner diameter of flange 74 to seal the interface between those two components. End 76 of tube 40 and end 71 (via flange 74) of tube 50 are then welded to tank 12 at holes 78 and 72. Glass is patched around the welds on an interior side of the tank shell.

Figure 15:
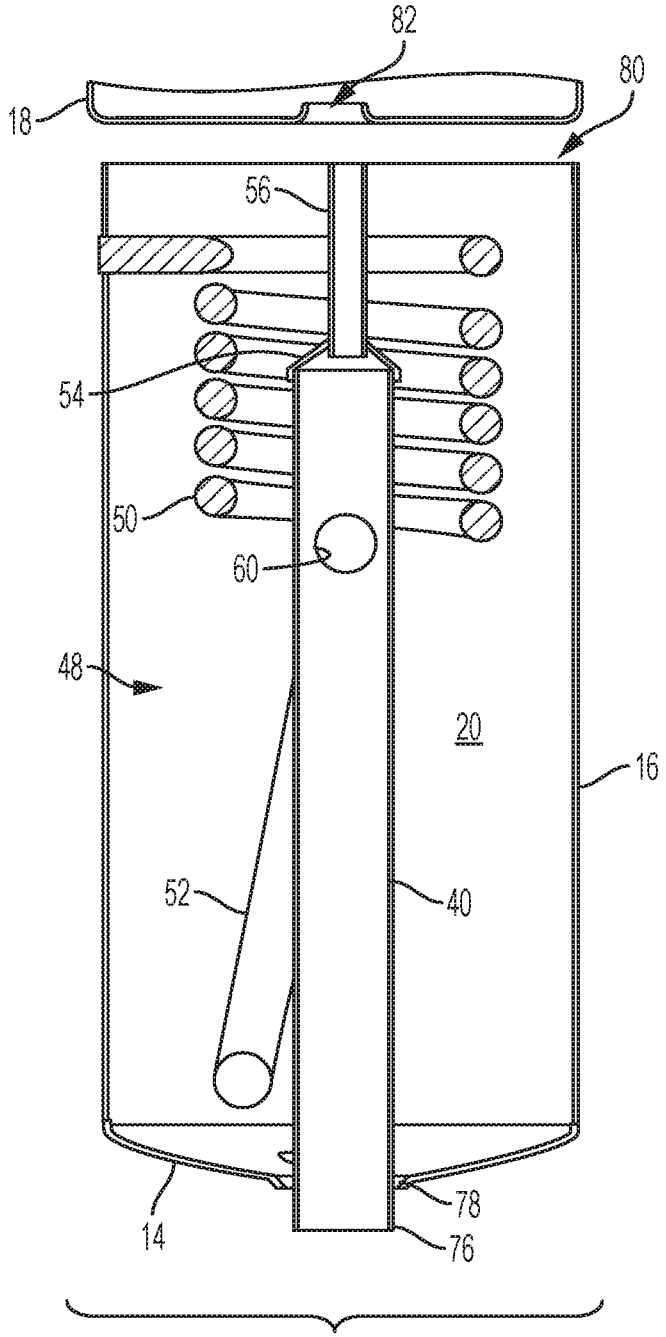
FIG. 15 is a partial side and exploded view, partly in section, of the gas-fired water heater as in FIG. 1.
Figure 16:
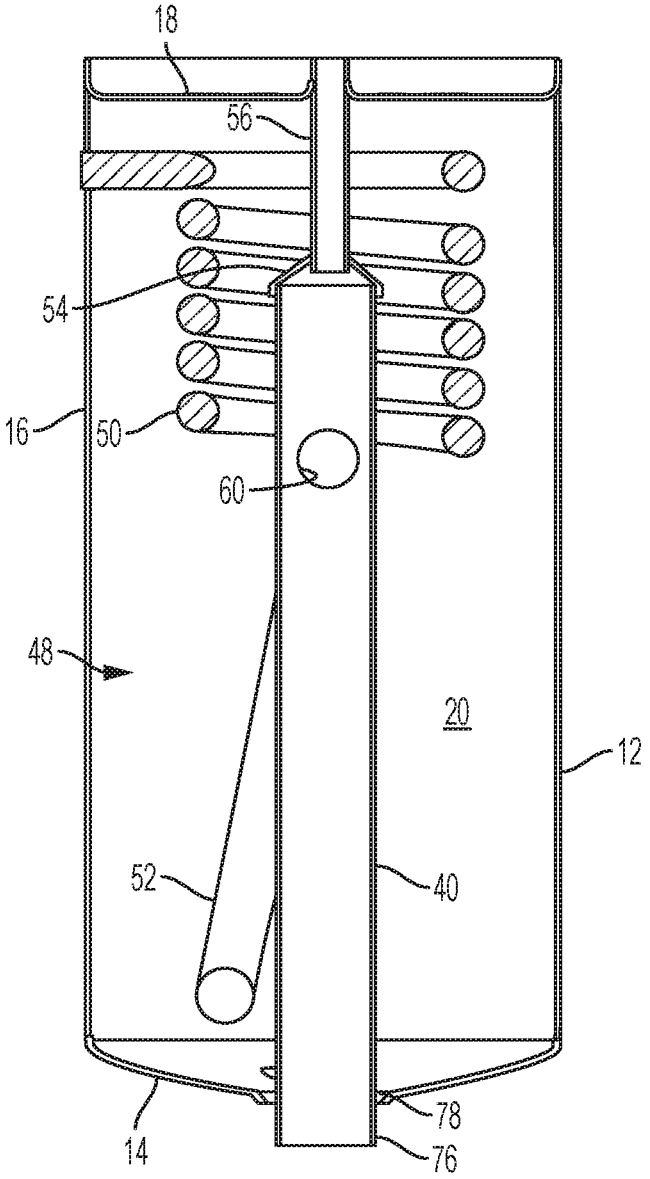
FIG. 16 is a partial side view, partly in section, of the gas-fired water heater as in FIG. 1.

Referring to FIG. 15, bottom wall 18 is then fitted down into an opening 80 defined by the bottom edge of tank wall 16. A center through-hole 82 defined in bottom wall 18 receives the distal end of post 56 as wall 18 fits into hole 80. Referring also to FIG. 16, a down-turned peripheral lip of wall 18 is welded to wall 16 at the edge of hole 80, and post 56 is welded to wall 18 at hole 82.

Heat exchanger 48 is configured to remove enough heat from the exhaust flow that some or all of the exhaust gas condenses to a liquid within the heat exchanger. At the heat input rate (e.g. Btu/hr), tank water volume, and flue system construction and geometry described above, exhaust gas produced by burner 34 (FIG. 4) in combustion tube 40, after flowing through transition tube 52 and into condensing tube 50, typically reaches the dew point in tube 50, thereby condensing from a gas to a liquid. The operation of tube 50 as a condensing tube results primarily from the tube's cross-sectional area, the surface area exposed to the exhaust gas, on one side, and the water in tank volume 20, on the other side, and the velocity of the gas moving through the tube.

To increase the heat transfer between the exhaust gas and the water in tank volume 20, tube 50 is formed in a non-linear shape, in this example a coil, between its connection to transition tube 52 and its exit from the water tank at 72, thereby increasing the heat exchanger's surface area that exists between the combustion exhaust fluid (whether in the form of a gas or a liquid) and the water in tank volume 20. If heat transferability alone is considered in designing the coil of tube 50, there is an incentive to maximize the number of turns, while minimizing the pitch of those turns (i.e. the distance between adjacent turns). As noted above, in the illustrated embodiments, the coil of tube 50 has about four and one-half turns, at a three inch pitch, with a total length of the tube within the coil of about sixteen inches.

As should be understood, velocity of a compressible fluid is directly proportional to the fluid's stagnation temperature and its constant pressure specific heat. Accordingly, as exhaust gas passes through the flue pipe system, contributing heat to the flue pipe walls (and therefore cooling), the exhaust fluid flow velocity decreases. However, the rate at which the exhaust fluid contributes heat to the flue pipe walls is also directly proportional to the exhaust fluid velocity. That is, the faster the exhaust fluid flows through the pipe, the greater the heat transfer, and vice versa. In the presently-described embodiments, it is desirable to increase the heat contributed by the exhaust fluid to the flue pipe walls. Because this heat is, in turn, contributed to water in the tank volume, increasing this heat transfer increases the water heater's efficiency because more energy is contributed to the water without a corresponding increase in the amount of energy required by the system in transferring the incremental heat to the water. Thus, the fluid pipe system is designed to maximize the heat transfer from the exhaust fluid to the pipe, which in the presently-illustrated embodiments is achieved primarily by reducing the cross-sectional area of condensing pipe 50 with respect to the cross-sectional area of combustion pipe 40 to thereby maintain a desired local velocity of the exhaust fluid. In this embodiment, the exhaust fluid contributes enough heat that the exhaust gas condenses to a liquid within the coil of pipe 50. The point at which condensation occurs depends upon the dew point which, as should be understood, depends on environmental conditions.

More specifically, as the exhaust fluid temperature decreases as the fluid moves through the tubes, the heat exchanger tube size has to decrease (according to the ideal gas law) to keep pressure constant or, if constant-diameter tubes as used, at least above a predetermined threshold needed to maintain a desired heat transfer to the tube walls. As the exhaust (initially gas) temperature drops, the gas volume decreases, which in turn drops the gas velocity through the tube. The conservation of energy means that $V_{max}=(2c_pT_t)^{1/2}$, where $V_{max}$ is the maximum velocity of the gas, $c_p$ is the constant pressure specific heat, and $T_t$ is the stagnation temperature of the gas flow. Thus, as temperature decreases, velocity should decrease. To keep a constant velocity (or at least above a predetermined floor velocity), then, the pressure should increase, to thereby increase the constant-pressure specific heat. To do that, the presently described embodiments decrease the pipe diameter from the combustion tube to the condenser coil.

As noted above, the diameter of the circular cross-sectional area of combustion tube 40 is approximately five and one-half inches (or, about 5.18 inches internal diameter). As reflected by the discussion above, greater heat transfer could be achieved in the combustion tube by reducing its diameter, and in certain embodiments, the combustion tube diameter reduces continuously from the burner to transition tube 52. In the presently-illustrated embodiment, however, a constant-diameter tube is utilized for ease of manufacture. This tube therefore has a diameter sufficiently large to accommodate burner 34 (FIG. 4), which thereby serves as a limiting lower boundary condition for the diameter of tube 40. Moreover, due to the very high heat of the exhaust gas in combustion tube 40, a reduction of its cross-sectional area could increase the amount of heat contributed to the tube walls to a point greater than the water's capacity to remove the heat, thereby causing localized heat spikes (i.e. instances of high heat flux) within the tube wall that could damage the tube. Thus, the tube wall is maintained at least at an about five and one-half inches external diameter (about 5.18 inches internal diameter) throughout its length between the burner and the intermediate tube opening at 60, although it should be understood that the tube 40 diameter could be larger if desired.

In certain embodiments, transition tube 52 changes from a cross-sectional area equal to that of combustion tube 40 (at the point at which the intermediate tube connects with the combustion tube) to a smaller cross-sectional area approximately equal to the internal cross-sectional area of condensing tube 50 (at to the point at which the intermediate tube connects with the condensing tube) at a continuous, constant rate of change. In the presently-illustrated embodiment, however, intermediate tube 52 has a constant cross-sectional area, except at the point 62 at which the end of the tube is crimped or swedged to fit within intake end 69 of the condenser tube. A diameter of this constant cross-sectional area tube is chosen between the diameter of combustion tube 40 and the diameter of condensing tube/coil 50 based on an optimization procedure described below. As illustrated in the Figures, intermediate tube 52 is formed in an upside-down U shape. As such, there are no flat sections on its interior surface at which liquid may collect. In particular, referring to FIG. 6, the inner surface of transition tube 52 is sloped toward condensing tube 50 from the point at which the intermediate tube joins the condensing tube to the apex of curved section 70 of tube 52. As noted above, the dew point may change, depending on environmental conditions, and it is possible that condensation may occur in the transition tube. Accordingly, the slope of the last approximately one-third-to-two-thirds (in this instance, about two-thirds, but in other embodiments at least half) of the length of transition tube 52, being sloped toward condensing tube 50, assures that, even if condensation occurs in the transition tube, the resulting liquid flows to the condensing tube. In the illustrated embodiments, the transition tube is disposed at an angle (measured between the center axes of the elongated portions of the tube and horizontal) less than ninety degrees, but it should also be understood that the tube could be disposed vertically, particularly in embodiments in which the combustion tube 40 does not extend in a directly vertical direction. Further, the condensing tube is sloped, from its end 69 connecting with the transition tube end 62, toward end 71, assuring that liquid formed in or received by condensing tube 50 flows to end 71 and therefrom to a vent system (not shown). As used herein, a slope "to" a given point refers to a positive angle, whether constant or varying, between the sloped surface and horizontal, with respect to that point.

It will be understood that the greatest local velocity of exhaust gas passing through intermediate tube 52 occurs at curved portion 70. Accordingly, the highest heat transfer of the intermediate pipe occurs at curve 70. Accordingly, the intermediate tube is positioned so that curve 70 is disposed proximate (i.e. about two to three inches from) hot water outlet hole/fitting 24.

The susceptibility of relatively small flue pipes in gas-fired water heaters to heat loads has been known, and conventional water heaters have therefore utilized relatively large flue pipe surface areas to avoid high localized heat loads and surface temperatures. Such practices, however, result in relatively higher weight and material costs. That is, it is desired to maximize the surface area of condenser tube 50, and indeed the surface area of all three tubes comprising heat exchanger 48, but, on the other hand, to minimize the surface area in order to minimize cost. A controlling factor in resolving these contrary incentives is the maximum rate at which heat transfers from the metal pipe to the water. Ideally, the temperature and velocity of the combustion gases will be such that the tube walls of heat exchanger 48 will transfer heat to the water in volume 20 at this maximum rate at all points along the heat exchanger tubes, and the total length and cross section of the tubes (i.e. surface area of the tubes) will be such that, at this maximum rate of heat transfer, or heat flux, the combustion exhaust gases would condense just at the point it reaches the end of the heat exchanger within the water volume, at 72. Such an arrangement would maximize the heat exchanger's ability to transfer heat from the exhaust gas to the water, while also minimizing the use of heat exchanger tubing beyond that needed to condense the gas.

As should be understood, however, the heat transfer rate along the tubing lengths will not be uniform. Heat flux within a heat exchanger tube is generally higher, for example, at turns in the tubing than along extended linear portions of the tubing. Given the folded path of the tubes comprising heat exchanger 48, then, there will be points within the heat exchanger at which the exhaust gas contributes heat to the tubing metal at a rate higher than at others. To the extent this contribution of heat from the exhaust gas to the tubing metal is greater than the maximum rate at which the metal can contribute heat to the water (i.e. the maximum heat flux), the temperature of the metal at such points increases. If the heat accumulation is sufficiently large, damage to the metal, to an enamel coating, or to joints between the distinct tubing sections comprising the heat exchanger, may result. Thus, it is also desired that the heat exchanger tubes maintain a geometry that minimizes local heating above the heat level of the tubes generally along their lengths.

Figure 18:
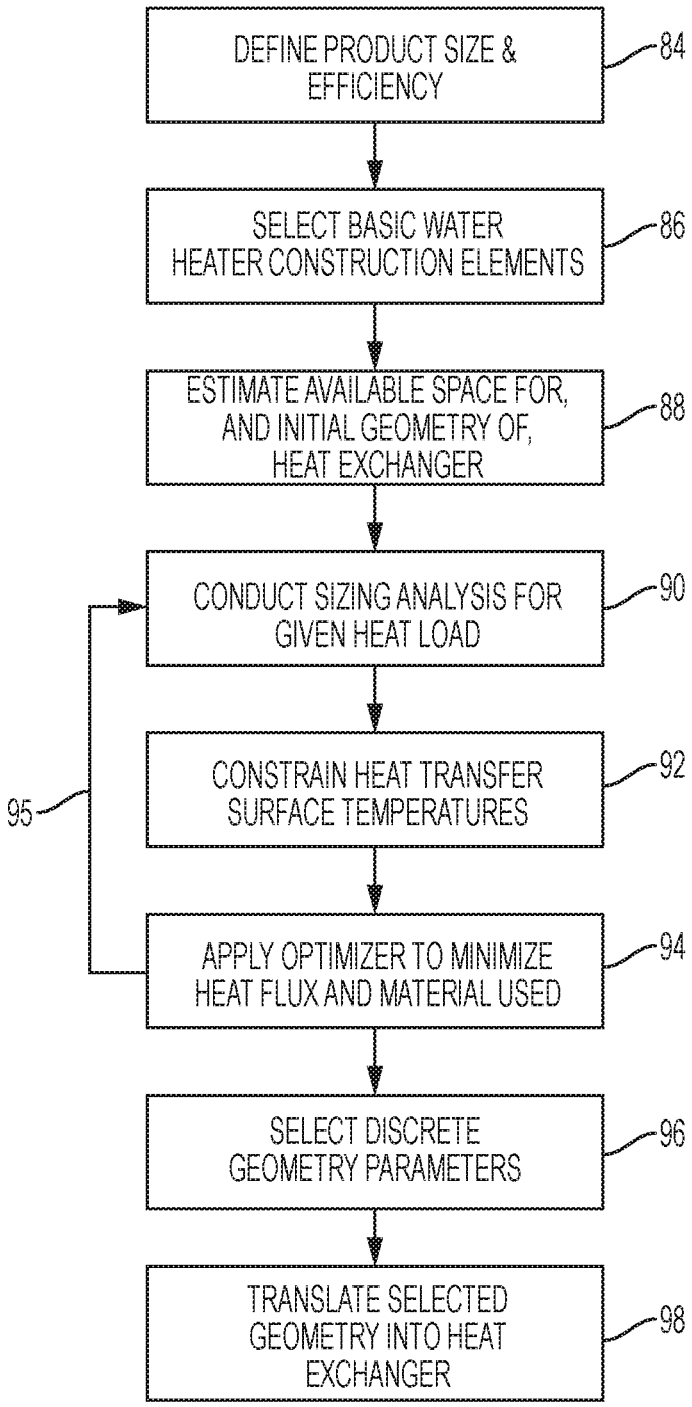
FIG. 18 is a flow chart of methods steps in the design of a gas-fired water heater as in FIG. 1.

Accordingly, and referring now to FIG. 18, a method is illustrated for optimizing the construction of a flue pipe system (such as but not limited to heat exchanger 48) to (a) remove exhaust gases from the water heater and (b) maximize heat transfer through the flue pipe walls to the tank water, while (c) reducing flue pipe surface area and, therefore, costs, but (d) avoiding localized heat load spikes.

At step 84, the water heater manufacturer defines the size of the water heater (in terms of the volume of the tank interior and, therefore, the volume of water the tank will hold), the heat input rate, and the desired efficiency. At 86, the manufacturer determines the remaining configuration of the water heater, for example whether the water heater will utilize a top-fired or a bottom-fired burner.

At 88, the manufacturer defines the maximum volume available for the flue system/heat exchanger and defines its initial geometric and dimensional characteristics. With regard to available volume, the manufacturer knows the desired water storage volume (i.e. the tank's interior volume, less the volume taken by the flue system). If there are limits to the overall volume that may be occupied by the water heater or the water heater tank, such limitations can translate into a limit in the available volume of the heat exchanger, given the desired water volume. The manufacturer also determines an initial estimate of the desired surface area of the flue/heat exchanger, based upon the following relationship:

$$Q=U*A*(\Delta T/x).$$

Q is the heat transfer rate from the heat exchanger to the tank water and may be considered the heat input rate (discussed above), multiplied by the water heater's efficiency. That is, if the rate at which the burner contributes heat to the system is known, and the desired system efficiency is known, then the rate at which the flue system should contribute heat to the water is the heat input rate multiplied by the target efficiency. U is the overall heat transfer coefficient. Heat transfer coefficients for given materials (in this instance, for example, C1010 cold rolled steel) and thicknesses of such materials should be understood. ΔT/x is the heat exchanger's temperature gradient. As should be understood, ΔT is a function of the difference in temperature between the flue gas at the point of its generation at the burner and at its exit from the flue system, and of the change in temperature between the water that flows into the water tank and the water that is output from the water tank (i.e. the water that receives heat from the exhaust). The input water temperature can be considered the average temperature of water from the municipal water system that feeds the water heater, and the output water temperature may be considered the water heater's upper set point. "x" is the heat exchanger wall thickness. Solving for "A," i.e. surface area, provides an initial estimate of the surface area needed for the flue system/heat exchanger in order to achieve a heat transfer sufficient to provide the desired water heater efficiency. As indicated above, wall thickness varies among the three tubes of the flue system, and the determination of the area A is thus the combination of these determinations of area A for the three individual tube sections. Since ΔT in the three individual calculations is a subset of the overall ΔT discussed above, the incremental ΔT values can be estimates based on experience or through testing or modeling.

Accordingly, at step 88, the manufacturer knows the maximum volume for the heat exchanger and has an initial estimate of the surface area needed to achieve a desired heat transfer. From this information, the manufacturer can select a desired geometric configuration for the heat exchanger. As an example, and referring to the embodiments of a water heater with a top-fired burner as illustrated in the Figures, the manufacturer may determine that the heat exchanger will have a first section configured as a generally cylindrical tube having an internal diameter large enough to accommodate the burner. For ease of manufacture, the tube is chosen to have a consistent diameter through its length and extends the majority of the height of the tank interior. This initial choice utilizes a portion, but not all, of the available heat exchanger volume and surface area. The manufacturer then selects a coil to extend outward of and around the first tube, thereby utilizing most of the remaining volume and surface area available for the flue system. The available height of the tank interior, the available tank interior diameter, and the need to allow sufficient space between the coil surfaces to allow intervening water, are limitations to the coil geometry.

Although the first tube's diameter is bounded on its low end by the size of the burner, the diameter of the coiled tube can be smaller. The manufacturer selects an initial coil diameter that is smaller than the diameter of the first tube so that, as described in more detail above, the velocity of the exhaust gas in the coil tube will remain generally the same as or greater than the velocity of the exhaust gas in the large first tube. An intermediate tube is then selected to connect the first tube with the coil tube, where the intermediate tube diameter is between the diameters of the first tube and the coil tube, thereby facilitating the transition between the other two diameters. Given the three tube diameters, the lengths of the three tubes are chosen so that the collective heat exchanger arrangement has the surface areas for the three tubes calculated as above, or greater. Also as discussed above, in the illustrated embodiments the intermediate tube is shaped and disposed so that a portion of the tube is located proximate the water tank outlet, so that the tube contributes heat directly to the exiting water.

At step 90, the manufacturer executes, on a computer system, a computational fluid dynamics (CFD) software program that uses a finite element analysis to simulate the water heater's operation, including flow of the exhaust gas through the heat exchanger. One example of such a system that may be used as described herein is ANSYS Fluent, available from ANSYS, Inc. of Canonsburg, Pa., though it should be understood that other such CFD systems, which should be understood in this art, may be used. Inputs to the CFD system include the diameter, geometry (e.g. shape of the first tube, shape and pitch of the coil tube, and shape of the transition tube), material, and wall thickness of each tube, the locations of each tube in the tank volume, and the water's capacity to accept heat. Other inputs include water heater boundary conditions, such as starting water temperature, water flow conditions, starting gas temperature, gas flow conditions, metal thermal properties, and heat input rate. The CFD system models and theoretically operates the water heater, determining an expected heat flux over all localized points over the surfaces of the flue pipes during the water heater's operation. As outputs, the CFD system provides the maximum surface temperatures over all the surface area of the heat exchanger during the water heater's operation, the pressure drop from one end of the flue system to the other, and the resulting water temperatures proximate the heat exchanger (thereby enabling determination of the total heat transferred to the tank water).

Generally, due to the calculation described above, it will be expected that the result of the CFD analysis at 90 will be that the proposed flue system transmits sufficient heat to obtain the desired heat transfer rate as noted above. It will not be known, however, whether (a) the surface area of flue system is the minimum needed while still maintaining at least the desired heat transfer rate, thereby reducing cost, (b) the maximum surface temperature over the flue system is the minimum obtainable while maintaining at least the desired heat transfer rate, thereby minimizing damage to the flue system structure, and (c) the pressure drop across the flue system is the minimum obtainable, while maintaining at least the desired heat transfer rate. Accordingly, at 92, the manufacturer changes one or more design parameters within the flue system, for example the length of any of the three tubes and the diameter of any of the three tubes and, at 94, re-executes the CFD analysis, as indicated at 95.

The manufacturer may execute multiple simulations at 94, corresponding to respective variations in the flue design made at 92. In certain embodiments, the manufacturer may limit flue system variations to changes in tube length and diameter, as opposed to changes in shape of the tubes in the flue, although it should be understood that the tube shape may also be changed and that water heater operating parameters, such as blower speed, and therefore heat input rate, may also be varied, in other embodiments. Still further, in such embodiments, the manufacturer may limit the available options for changes in tube diameters to those diameters for which steel tubes are commercially available. With this consideration, the manufacturer may define ranges of available discrete tube diameter values for each of the three tubes and ranges of tube lengths available for each of the three tubes that generally maintain the flue system surface area at substantially the tube surface areas as calculated above. Thus, given these ranges, the manufacturer may select available tube diameters within the predefined diameter ranges for the tubes, and select various lengths for each of the three tubes within the predefined length ranges for each of the three tubes, select multiple water heater configurations comprising discrete combinations of these selected diameters and lengths, and execute, at 94, a CFD analysis (as at 90) for each such water heater configuration.

At 96, the manufacturer selects the water heater configuration arising from steps 90 and 94 having results from the CFD analysis indicating (a) a heat transfer rate at or above the desired heat transfer rate as noted above, (b) that no surface temperature over the entire flue system exceeds a predetermined maximum surface temperature (e.g. the yield stress for a given flue wall) at which damage to the flue pipe wall or an enamel coating is likely or reasonably possible to occur, and that the configuration, among the other configurations modeled at steps 90 and 94, minimizes (c) the difference between exhaust gas pressure at the beginning of the flue system and exhaust gas pressure at the end of the flue gas systems (i.e. at or proximate the point at which the exhaust gas flows out of the flue gas system), (d) the highest surface temperature to occur over the flue system surface area, and (e) the total surface area of the flue. Where, as in these examples, selection of a water heater configuration encompasses multiple minimization criteria, such that there may be no single resulting configuration at which minimization of all the minimized criteria occurs, the CFD system, or a custom-programmed system that receives and analyzes the CFD system output, may execute a scoring algorithm to select the final configuration or a range of final configurations from which manufacturer selects the final configuration. At 98, the manufacturer assembles a water heater, as described above, with a flue gas system having the geometric configuration and dimensions selected as described with respect to steps 84-96.

Alternatively, the manufacturer may provide a custom-coded computer program, operable on a computer system as described below with respect to FIG. 19, that determines the various water heater configurations to use as inputs to the CFD system, which is also executed on the computer system in the form of executable program instructions, controls the CFD system to execute the CFD analysis for each configuration, and analyzes the outputs of the CFD analyses to thereby select one or more water heater configurations. The manufacturer provides the custom program with the general configuration and operating parameters of the water heater, the geometry of the flue pipes, and the boundaries for the tube length and tube diameter ranges as discussed above. The custom program selects incremental changes in tube lengths and tube diameters, determines therefrom all the discrete water heater configurations arising from those incremental changes, and executes the CFD analyses for all the combinations. The custom program selects from the CFD analysis results the water heater configuration meeting the above-described criteria or some number of configurations within a predetermined range from the best result. For example, the custom program may select all water heater configuration results that meet the first two of the five criteria discussed above and that are within a predetermined range of the best scoring algorithm result. From the water heater configurations corresponding to these results selected by the custom program, the manufacturer may select at 96 a final configuration for assembly at step 98 based on any criteria at the manufacturer's discretion. Still further, the custom program can be programmed to execute an optimization process, whereby the manufacturer provides to the custom program the general configuration and operating parameters of the water heater, the geometry of the flue pipes, and the boundaries for the tube length and tube diameter ranges as discussed above and defines a starting configuration within those parameters and boundaries, and the custom program instructs the CFD system/program to execute the CFD analysis for the starting point configuration, assesses the starting point configuration based on the criteria described above, and then selects a next guess water heater configuration in a direction likely to provide a better result than the previous result. The custom program instructs the CFD system to execute the CFD analysis for the next guess, compares the result with the previous result, and makes a further guess, repeating the process until identifying one or more local optimized results among the set of possible results. The custom program may be programmed to report the overall best optimized result, all the local optimized results, or, for example, all results within a predetermined range of the overall best result or local results. Procedures for optimizing model data should be understood and are therefore not discussed in further detail herein.

As reflected above, procedures for selecting a final water heater and flue system configuration may vary, and the description above should be understood to be an example but not exhaustive of the methods that may be employed. For example, the five criteria explained above may be changed in various ways as desired. For instance, one or more of the criteria can be eliminated, and/or other criteria can be included.

Figure 17:
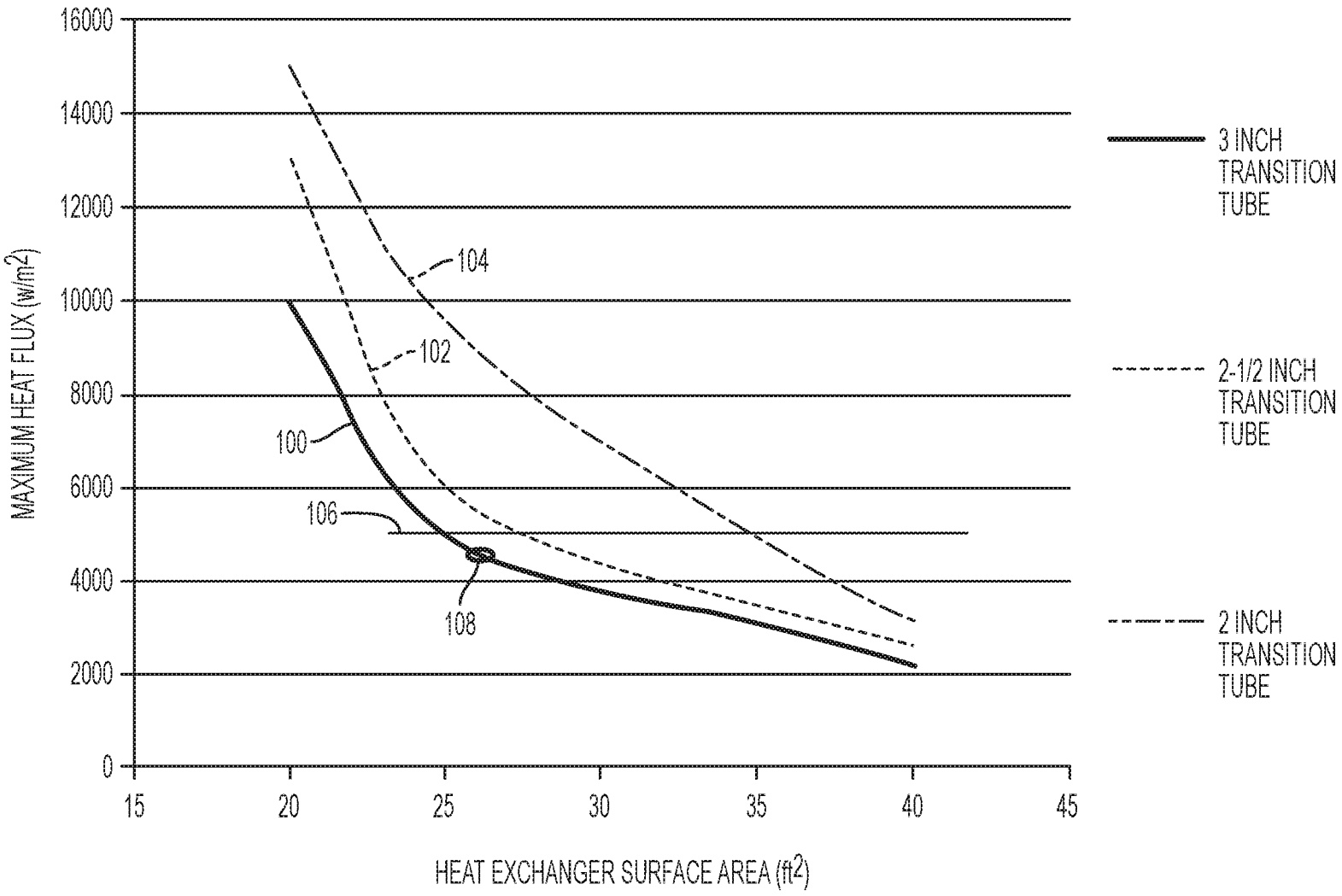
FIG. 17 is a graphical representation of part of an optimization process utilized in designing a flue tube system for use in the gas-fired water heater as in FIG. 1.

A graphical depiction of the optimization process is illustrated at FIG. 17. Each of lines 100, 102, and 104 represents a given option for the transition tube inner diameter. Note also the critical heat flux level, indicated at 106. The y-axis in the chart is the maximum heat flux that occurs anywhere along the exhaust fluid's path through the heat exchanger. If it is desired to maintain tube 40 below this heat flux level, then the optimization selects the transition tube diameter that meets this requirement and also minimizes the surface area of the heat exchanger tubes, as indicated at 108.

Figure 19:
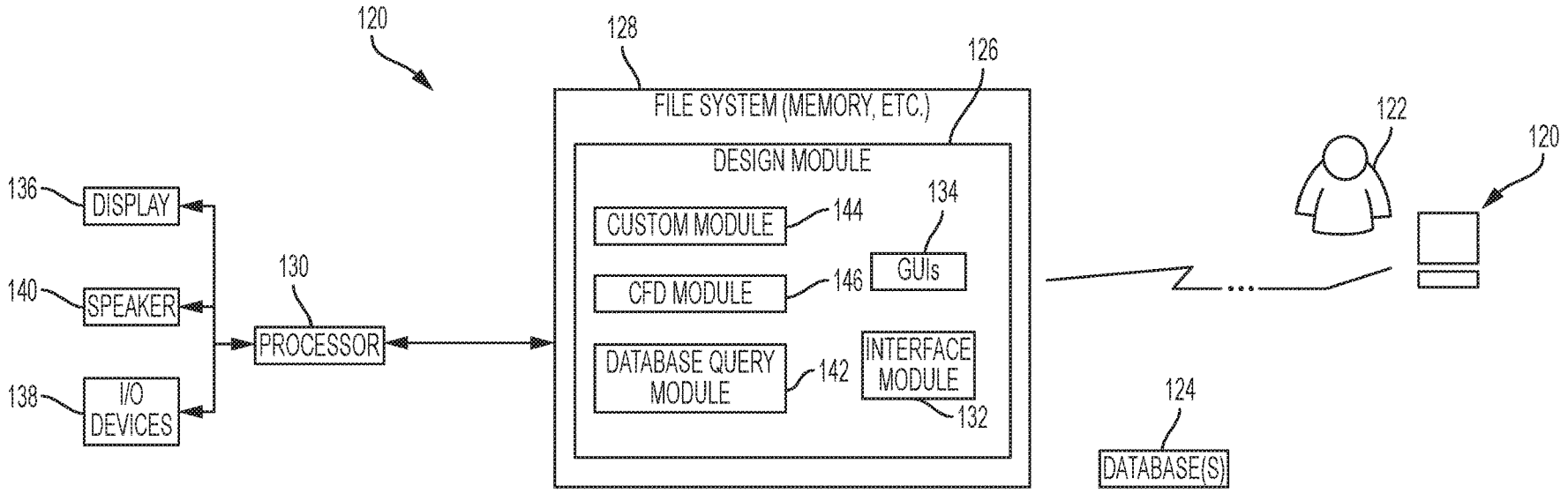
FIG. 19 is a schematic illustration of a system for designing a gas-fired water heater as in FIG. 1.

FIG. 19 is a block schematic diagram of a system 120 that performs the design analysis as discussed above with respect to FIG. 18. Computer system 120 may be a computer system in the possession of a manufacturer administrator 122 or may be a server at a locationally remote data center accessed by the manufacturer via a local computer system over a wide area network such as the Internet. Computer system 120 may be a server, a non-server computer system such as a personal computer or a mobile device, or may comprise a plurality and/or combination of such computer systems, but is generally a computing device or device capable of effecting the communications and functions as described herein. Where computer system 120 is a server accessible over a local area network or at a locationally remote data center accessible over a wide area network such as the Internet, the computer system may be considered to include a workstation, mobile computer, or other device through which such access is effected. In general, it should be understood that a single computer system need not execute all the computer-related steps discussed with respect to FIG. 18 and that multiple computer systems can be utilized. A database 124 may be a part of computer system 120 or may be accessible by the computer system over a local or wide area network. Database 124 may store water heater arrangement and operational parameters and water heater/flue system configurations, as discussed herein, and may comprise one or multiple databases.

One or more of the methods as discussed herein is embodied in or performed by a design module 126. Design module 126 may be a self contained software system with embedded logic, decision making, state-based operations and other functions that may operate in conjunction with collaborative applications, such as web browser applications, software applications, and other applications that can be used to communicate with an operator, and in the illustrated embodiment comprises computer-executable instructions stored on a computer-readable medium. Such a computer program typically is comprised of a multitude of instructions that may be translated by a computer into a machine-readable format and hence executable instructions. In the illustrated embodiment, computer system 120 stores design module 126 on a file system or memory 128, accesses the design module from the file system and runs the design module on a processor 130 that is part of computer system 120. Manufacturer administrator 122 may interact with the self-contained system as part of a process of designing a water heater/heat exchange system as described herein.

Design module 126 may include various submodules to perform the steps discussed herein, including a submodule 132 that interfaces with other computer systems to thereby allow the manufacturer administrator to upload and/or download information. Interface module 132 also allows the computer system to query and receive data from database 124 and distribute received data to one or more other submodules in design module 126, as appropriate, for further processing. A query to submodule 132 may take the form of a command message that presents a command to the appropriate computer system or database, such that module 132 in turn compiles the command and executes the requested function, such as retrieving information from database 124.

Transaction module 126 may also include graphical user interfaces ("GUIs") 134. Transaction module 126 may present, for instance, one or more predetermined GUIs 134 to permit an administrator at the manufacturer to input/select data into the system, direct computer system 120 to perform various functions, define preferences associated with a query, or input other information and/or settings. GUIs 134 may be predetermined an/or presented in response to attempts by the administrator to perform operations, such as those discussed above with respect to FIG. 18, execute queries, enter information and/or settings, operate functions of other modules, or communicate with other computer systems. Computer system 120 generates the predetermined GUIs and presents GUIs 134 to the administrator on a display 136 of computer system 120, which may be at a local computer device where computer system 120 comprises a server remote from the administrator. GUIs 136 can be custom-defined and execute in conjunction with other modules and devices on computer system 120, such as I/O devices 138, the interface submodule, or any other submodule. GUIs 138 present notifications to users and may be used whenever a user desires to transmit or retrieve data between computer systems and/or databases.

Computer system 120 may also include display 136, I/O devices 138, and a speaker 140. Display 136 may present applications for electronic communications and/or data extraction, uploading, downloading, etc., and may display water heater configuration input data and CFD analysis output data, as described herein. Speaker 140 may present any voice or other auditory signals or information to administrator 122 in addition to or in lieu of presenting such information on display 136. Computer system 120 may also include one or more input devices, output devices, or combination input and output devices, collectively I/O devices 138. I/O devices 138 may include a keyboard or similar means to control operation of applications and interaction features as described herein, as well as hand-held scanners for optically scanning documents for storage in database 124. I/O devices 138 may also include disk drives or devices for reading computer-readable storage medium, including computer-readable or computer operable instructions. Such devices should be understood.

Transaction module 126 also includes a module 142 to query databases. Query module 142 allows a user to query data from database 124 via interface module 132. After transmission of a query message and retrieval of the query results, query module 142 may store the retrieved data in the memory for future retrieval.

Transaction module 126 also includes a custom module 144 and a CFD module 146. Custom module 144 is a set of computer executable instructions that effects the steps discussed above encompassed by the custom program. It receives input data, as discussed above, from administrator 122 either directly via I/O devices 138, GUIs 134, and interface module 132 and/or via the administrators selection of pre-existing data from database 124 via I/O devices 138, GUIs 134, query module 142, and interface module 132. The custom module provides data and instructions to, and receives CFD analysis output data from, CFD module 146 via interface module 132 and displays the output data at display 136 and/or to another computer system as output data via a communications port (not shown) and interface module 132. The custom module may also store the output data at database 124 via interface module 132. In those embodiments in which administrator 122 manually defines the water heater configurations, without a custom program, the administrator provides water heater configuration input data and operation instructions to the CFD module via I/O devices 138 and interface module 132. CFD module 146 executes the CFD analyses as discussed herein and displays the output data at display 136 and/or to another computer system as output data via the communications port and interface module 132 and may store the output data at database 124 via interface module 132.

While one or more preferred embodiments of the invention are described above, it should be appreciated by those skilled in the art that various modifications and variations can be made in the present invention without departing from the scope and spirit thereof. For example, elements of one embodiment may be combined with another embodiment to create a still further embodiment. It is intended that the present invention cover such modifications and variations as come within the scope and spirit of the present disclosure, the appended claims, and their equivalents.

What is claimed is:

1. A water heater, comprising:

a tank defining an interior volume for holding water;

a burner in communication with a fuel source and an air source;

a first flue tube having a first cross-sectional area, extending generally vertically into the interior volume, and being disposed in communication with the burner so that an interior of the first flue tube receives exhaust fluid from combustion of fuel from the fuel source at the burner;

a second flue tube disposed within the interior volume and having a second cross-sectional area and a length, wherein the second flue tube is non-linear along at least a portion of the length within the interior volume;

a third flue tube having a third cross-sectional area and that is attached in fluid communication with the first flue tube within the interior volume, that is attached in fluid communication with the second flue tube within the interior volume, and that extends between the first flue tube and the second flue tube so that the exhaust fluid from the first flue tube flows to the second flue tube via the third flue tube, wherein an interior surface of the third flue tube slopes toward the second flue tube over at least a portion of the third flue tube extending from its attachment to the second flue tube; and an outlet that extends through the tank from the interior volume to an area exterior of the tank, wherein the second flue tube is connected to the outlet so that said exhaust fluid flows from the second flue tube through the outlet, the second flue tube is sloped toward the outlet over its length between the third flue tube and the outlet, the first cross-sectional area is greater than the third cross-sectional area, the third cross-sectional area is greater than the second cross-sectional area, the third flue tube has a length and has an inverted U-shape along the length of the third flue tube between the first flue tube and the second flue tube, and the third flue tube connects to the first and second flue tubes at respective opposite ends of the inverted U-shape.

2. The water heater as in claim 1, wherein the third flue tube is disposed entirely within the interior volume.

3. The water heater as in claim 1, wherein the second flue tube is disposed in a bottom half of the interior volume, wherein the third flue tube extends above the second flue tube into an upper half of the interior volume.

4. The water heater as in claim 3, wherein the interior volume defines a vertical length and the second flue tube and the third flue tube extend at least 80% of the vertical length.

5. The water heater as in claim 3, wherein the interior volume defines a vertical length and the second flue tube and the third flue tube extend at least 90% of the vertical length.

6. The water heater as in claim 1, wherein the first cross-sectional area is between about 19 square inches and about 23 square inches.

7. The water heater as in claim 1, wherein the second cross-sectional area is between about three square inches and about seven square inches.

8. The water heater as in claim 1, wherein the third cross-sectional area is between about three square inches and about ten square inches.

9. The water heater as in claim 1, wherein the burner is disposed at an upper end of the first flue tube, so that the exhaust fluid flows from the burner down into the first flue tube.

10. The water heater as in claim 1, wherein the third flue tube connects to the second flue tube in a bottom half of the interior volume.

11. The water heater as in claim 1, wherein a curved portion of the third flue tube in the inverted U-shape is proximate a water outlet from the tank.

12. The water heater as in claim 1, wherein a portion of the third flue tube is proximate a water outlet from the tank.

13. The water heater as in claim 12, wherein the portion is a curved portion.

14. The water heater as in claim 1, wherein the burner is disposed below a bottom portion of the tank interior volume.

15. The water heater as in claim 1, wherein the water heater has only one of the first flue tube, only one of the second flue tube, and only one of the third flue tube.

16. The water heater as in claim 1, wherein the exhaust fluid is a gas in the first flue tube and a liquid in the second flue tube.

17. A water heater, comprising:

a tank defining an interior volume for holding water;

a burner in communication with a fuel source and an air source;

a first flue tube having a first cross-sectional area, extending into the interior volume downward from the burner, and being disposed in communication with the burner so that an interior of the first flue tube receives exhaust fluid from combustion of fuel from the fuel source at the burner;

a second flue tube disposed within the interior volume and having a second cross-sectional area and a length, wherein the second flue tube is non-linear along at least a portion of the length within the interior volume;

a third flue tube having a third cross-sectional area and that is attached in fluid communication with the first flue tube within the interior volume, that is attached in fluid communication with the second flue tube within the interior volume, and that extends within the interior volume between the first flue tube and the second flue tube so that the exhaust fluid from the first flue tube flows to the second flue tube via the third flue tube, wherein an interior surface of the third flue tube slopes toward the second flue tube over at least a portion of the third flue tube extending from its attachment to the second flue tube; and an outlet that extends through the tank from the interior volume to an area exterior of the tank, wherein the second flue tube is connected to the outlet so that said exhaust fluid flows from the second flue tube through the outlet, the second flue tube is sloped toward the outlet over its length between the third flue tube and the outlet, the first cross-sectional area is greater than the third cross-sectional area, the third cross-sectional area is greater than the second cross-sectional area, the third flue tube has a length and has an inverted U-shape along the length of the third flue tube between the first flue tube and the second flue tube, and the third flue tube connects to the first and second flue tubes at respective opposite ends of the inverted U-shape.

18. The water heater as in claim 17, wherein the second flue tube is disposed in a bottom half of the interior volume, wherein the third flue tube extends above the second flue tube into an upper half of the interior volume.

19. The water heater as in claim 18, wherein the interior volume defines a vertical length and the second flue tube and the third flue tube extend at least 80% of the vertical length.

20. The water heater as in claim 18, wherein the interior volume defines a vertical length and the second flue tube and the third flue tube extend at least 90% of the vertical length.

21. The water heater as in claim 17, wherein the first cross-sectional area is between about 19 square inches and about 23 square inches.

22. The water heater as in claim 21, wherein the second cross-sectional area is between about three square inches and about seven square inches.

23. The water heater as in claim 22, wherein the third cross-sectional area is between about three square inches and about ten square inches.

24. The water heater as in claim 17, wherein a portion of the third flue tube is proximate a water outlet from the tank.

25. The water heater as in claim 24, wherein the portion is a curved portion.

26. The water heater as in claim 17, wherein the water heater has only one of the first flue tube, only one of the second flue tube, and only one of the third flue tube.

27. The water heater as in claim 17, wherein the exhaust fluid is a gas in the first flue tube and a liquid in the second flue tube.

* * * * *